US006284189B1

(12) United States Patent
Pavlicevic et al.

(10) Patent No.: US 6,284,189 B1
(45) Date of Patent: Sep. 4, 2001

(54) NOZZLE FOR DEVICE TO INJECT OXYGEN AND TECHNOLOGICAL GASES AND RELATIVE DIMENSIONING METHOD

(75) Inventors: Milorad Pavlicevic; Stefano Morsut, both of Udine; Alfredo Poloni, Fogliano di Redipuglia, all of (IT)

(73) Assignee: Danieli & C. Officine Meccaniche S.p.A., Buttrio (IT)

( * ) Notice: Subject to any disclaimer, the term of this patent is extended or adjusted under 35 U.S.C. 154(b) by 0 days.

(21) Appl. No.: 09/436,256

(22) Filed: Nov. 9, 1999

(30) Foreign Application Priority Data

Nov. 10, 1998 (IT) ..... UD98A0195

(51) Int. Cl.[7] ..... C21B 7/10

(52) U.S. Cl. ..... 266/46; 266/217; 266/265; 239/601

(58) Field of Search ..... 266/217, 265, 266/216, 46, 225; 239/265.11, 600, 601

(56) References Cited

U.S. PATENT DOCUMENTS

| | | | | |
|---|---|---|---|---|
| 3,938,743 | * | 2/1976 | Miller | 239/600 |
| 4,057,421 | | 11/1977 | Fukui et al. . | |
| 4,993,691 | * | 2/1991 | Mousel et al. | 266/225 |
| 5,579,999 | | 12/1996 | Seiner et al. . | |
| 5,782,414 | * | 7/1998 | Nathenson | 239/601 |

FOREIGN PATENT DOCUMENTS

0234077 * 9/1987 (EP) .

OTHER PUBLICATIONS

Settles, G.S.; Geppert, S.T., "Redesigning Blasting Nozzles to Improve Productivity", Journal of Protective Coatings and Linings, vol. 13, No. 10, Oct. 1996, pp. 64–72.

Prasanth, R.K.; Whitaker, K.W.: "Neuromorphic Approach to Inverse Problems in Aerodynamics", AIAA Journal vol. 33, No. 6, Jun. 1995, pp. 1150–1152.

Brown E.F. E.A., "Survey of Methods for Exhaust–Nozzle flow analysis" Journal of Aircraft, vol. 13, No. 1, Jan. 1976 pp. 4–11.

* cited by examiner

*Primary Examiner*—Scott Kastler
(74) *Attorney, Agent, or Firm*—Stevens, Davis, Miller & Mosher, LLP

(57) ABSTRACT

Nozzle for device to inject oxygen and technological gases used in metallurgical processing of metal melting, the nozzle being suitable to emit a gassy flow at supersonic velocity, the nozzle having a conformation symmetrical to a central axis (x) defined by a throat arranged between the inlet and the outlet, the throat defining an upstream part with a convergent development and a downstream part with a divergent development which ends in the outlet mouth, the nozzle with the convergent/divergent development having a geometry such that the fall in pressure of the gassy flow from inlet to outlet has a hyperbolic tangent development. Dimensioning method for the nozzle as above, the method providing an inverse dimensioning approach wherein the geometry of the nozzle is adapted to the natural profile of the fall in pressure of the gassy flow according to a hyperbolic tangent development, thus obtaining an optimum variation of the aerodynamic parameters according to the natural laws of expansion.

20 Claims, 18 Drawing Sheets

Figure 1:
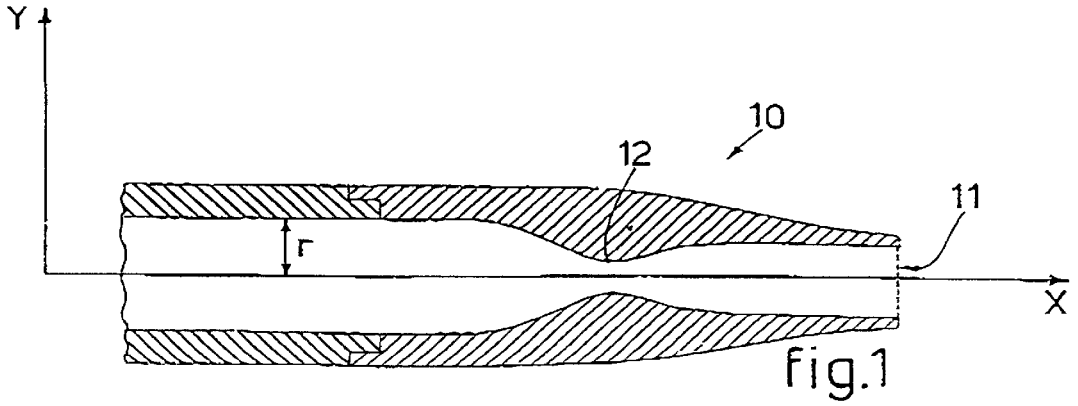

Nozzle profile
| | | |
|---|---|---|
| Type of nozzle | | L - Long |
| Dimensionless lenght of nozzle | $L/r^*$ | 16.00 |
| Mach Inlet | $M_{in}$ | 0.1 |
| Mach outlet | $M_{out}$ | 1.5 |
| Ratio between inlet temp. and outlet temp. | $T_{in}/T_{out}$ | 1.447 |
| Ratio between inlet pressure and outlet press. | $P_{in}/P_{out}$ | 3.6454486 |
x - position in axial direction
r - nozzle profile radius
r* - nozzle throat radius
| x/r* | r/r* |
|---|---|
| -7.000000 | 2.397350 |
| -6.937370 | 2.393580 |
| -6.774750 | 2.383780 |
| -6.612120 | 2.373400 |
| -6.449490 | 2.362040 |
| -6.286870 | 2.349270 |
| -6.124240 | 2.334690 |
| -5.961620 | 2.317880 |
| -5.798990 | 2.298430 |
| -5.636360 | 2.275940 |
| -5.473740 | 2.250150 |
| -5.311110 | 2.220830 |
| -5.148480 | 2.187730 |
| -4.985860 | 2.150650 |
| -4.823230 | 2.109340 |
| -4.660610 | 2.063620 |
| -4.497980 | 2.013860 |
| -4.335350 | 1.960780 |
| -4.172730 | 1.905100 |
| -4.010100 | 1.847550 |
| -3.847470 | 1.788840 |
| -3.684850 | 1.729640 |
| -3.522220 | 1.670520 |
| -3.359600 | 1.612070 |
| -3.196970 | 1.554880 |
| x/r* | r/r* |
|---|---|
| -3.034340 | 1.499440 |
| -2.871720 | 1.446080 |
| -2.709090 | 1.395090 |
| -2.546460 | 1.346770 |
| -2.383840 | 1.301320 |
| -2.221210 | 1.258860 |
| -2.058590 | 1.219520 |
| -1.895960 | 1.183390 |
| -1.733330 | 1.150550 |
| -1.570710 | 1.121050 |
| -1.408080 | 1.094920 |
| -1.245450 | 1.072180 |
| -1.082830 | 1.052810 |
| -0.920202 | 1.036740 |
| -0.757576 | 1.023880 |
| -0.594949 | 1.014050 |
| -0.432323 | 1.007040 |
| -0.269697 | 1.002590 |
| -0.107071 | 1.000380 |
| 0.055556 | 1.000100 |
| 0.218182 | 1.001400 |
| 0.380808 | 1.003980 |
| 0.543434 | 1.007530 |
| 0.706061 | 1.011790 |
| 0.868687 | 1.016530 |
| x/r* | r/r* |
|---|---|
| 1.031310 | 1.021560 |
| 1.193940 | 1.026700 |
| 1.356570 | 1.031820 |
| 1.519190 | 1.036820 |
| 1.681820 | 1.041630 |
| 1.844440 | 1.046180 |
| 2.007070 | 1.050440 |
| 2.169700 | 1.054380 |
| 2.332320 | 1.057990 |
| 2.494950 | 1.061270 |
| 2.657580 | 1.064230 |
| 2.820200 | 1.066870 |
| 2.982830 | 1.069230 |
| 3.145450 | 1.071300 |
| 3.308080 | 1.073130 |
| 3.470710 | 1.074730 |
| 3.633330 | 1.076120 |
| 3.795960 | 1.077330 |
| 3.958590 | 1.078370 |
| 4.121210 | 1.079270 |
| 4.283840 | 1.080040 |
| 4.446460 | 1.080700 |
| 4.609090 | 1.081270 |
| 4.771720 | 1.081750 |
| 4.934340 | 1.082160 |
| x/r* | r/r* |
|---|---|
| 5.096970 | 1.082510 |
| 5.259600 | 1.082810 |
| 5.422220 | 1.083060 |
| 5.584850 | 1.083270 |
| 5.747470 | 1.083450 |
| 5.910100 | 1.083610 |
| 6.072730 | 1.083730 |
| 6.235350 | 1.083830 |
| 6.397980 | 1.083920 |
| 6.560610 | 1.084000 |
| 6.723230 | 1.084050 |
| 6.885860 | 1.084090 |
| 7.048480 | 1.084110 |
| 7.211110 | 1.084130 |
| 7.373740 | 1.084150 |
| 7.536360 | 1.084160 |
| 7.698990 | 1.084170 |
| 7.861620 | 1.084170 |
| 8.024240 | 1.084170 |
| 8.186870 | 1.084170 |
| 8.349490 | 1.084170 |
| 8.512120 | 1.084170 |
| 8.674750 | 1.084170 |
| 8.837370 | 1.084170 |
| 9.000000 | 1.084170 |
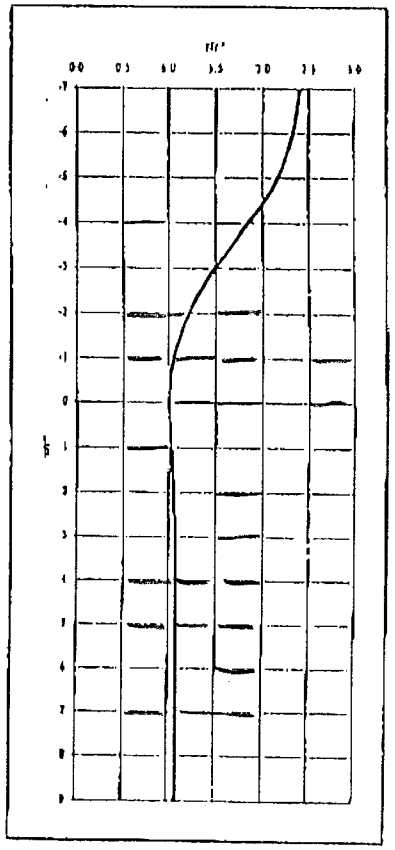

Nozzle profile
| | | |
|---|---|---|
| Type of nozzle | | M - Medium |
| Dimensionless lenght of nozzle | $L/r^*$ | 13.10 |
| Mach Inlet | $M_{in}$ | 0.1 |
| Mach outlet | $M_{out}$ | 1.5 |
| Ratio between Inlet temp. and outlet temp. | $T_{in}/T_{out}$ | 1.447 |
| Ratio between inlet pressure and outlet press. | $P_{in}/P_{out}$ | 3.6454486 |
x - position in axial direction
r - nozzle profile radius
r* - nozzle throat radius
| x/r* | r/r* |
|---|---|
| -5.700000 | 2.420130 |
| -5.567680 | 2.413140 |
| -5.435350 | 2.405150 |
| -5.303030 | 2.396500 |
| -5.170710 | 2.386870 |
| -5.038380 | 2.375930 |
| -4.906060 | 2.363320 |
| -4.773740 | 2.348710 |
| -4.641410 | 2.331760 |
| -4.509090 | 2.312040 |
| -4.376770 | 2.289010 |
| -4.244440 | 2.262090 |
| -4.112120 | 2.230740 |
| -3.979800 | 2.194390 |
| -3.847470 | 2.152490 |
| -3.715150 | 2.104830 |
| -3.582830 | 2.052170 |
| -3.450510 | 1.995410 |
| -3.318180 | 1.935460 |
| -3.185860 | 1.873220 |
| -3.053540 | 1.809580 |
| -2.921210 | 1.745350 |
| -2.788890 | 1.681310 |
| -2.656570 | 1.618260 |
| -2.524240 | 1.556960 |
| x/r* | r/r* |
|---|---|
| -2.391920 | 1.497930 |
| -2.259600 | 1.441490 |
| -2.127270 | 1.388000 |
| -1.994950 | 1.337730 |
| -1.862630 | 1.290830 |
| -1.730300 | 1.247380 |
| -1.597980 | 1.207470 |
| -1.465660 | 1.171140 |
| -1.333330 | 1.138440 |
| -1.201010 | 1.109390 |
| -1.068690 | 1.083990 |
| -0.936364 | 1.062230 |
| -0.804040 | 1.044050 |
| -0.671717 | 1.029350 |
| -0.539394 | 1.017960 |
| -0.407071 | 1.009660 |
| -0.274747 | 1.004130 |
| -0.142424 | 1.001040 |
| -0.010101 | 1.000000 |
| 0.122222 | 1.000670 |
| 0.254545 | 1.002680 |
| 0.386869 | 1.005740 |
| 0.519192 | 1.009570 |
| 0.651515 | 1.013940 |
| 0.783838 | 1.018660 |
| x/r* | r/r* |
|---|---|
| 0.916162 | 1.023550 |
| 1.048480 | 1.028490 |
| 1.180810 | 1.033370 |
| 1.313130 | 1.038120 |
| 1.445450 | 1.042670 |
| 1.577780 | 1.046980 |
| 1.710100 | 1.051020 |
| 1.842420 | 1.054770 |
| 1.974750 | 1.058210 |
| 2.107070 | 1.061350 |
| 2.239390 | 1.064200 |
| 2.371720 | 1.066760 |
| 2.504040 | 1.069050 |
| 2.636360 | 1.071090 |
| 2.768690 | 1.072890 |
| 2.901010 | 1.074470 |
| 3.033330 | 1.075860 |
| 3.165660 | 1.077070 |
| 3.297980 | 1.078120 |
| 3.430300 | 1.079030 |
| 3.562630 | 1.079810 |
| 3.694950 | 1.080480 |
| 3.827270 | 1.081060 |
| 3.959600 | 1.081560 |
| 4.091920 | 1.081980 |
| x/r* | r/r* |
|---|---|
| 4.224240 | 1.082340 |
| 4.356570 | 1.082650 |
| 4.488890 | 1.082910 |
| 4.621210 | 1.083130 |
| 4.753540 | 1.083320 |
| 4.885860 | 1.083480 |
| 5.018180 | 1.083610 |
| 5.150510 | 1.083710 |
| 5.282830 | 1.083800 |
| 5.415150 | 1.083880 |
| 5.547470 | 1.083940 |
| 5.679800 | 1.083980 |
| 5.812120 | 1.084010 |
| 5.944440 | 1.084040 |
| 6.076770 | 1.084060 |
| 6.209090 | 1.084070 |
| 6.341410 | 1.084080 |
| 6.473740 | 1.084080 |
| 6.606060 | 1.084090 |
| 6.738380 | 1.084090 |
| 6.870710 | 1.084090 |
| 7.003030 | 1.084090 |
| 7.135350 | 1.084090 |
| 7.267680 | 1.084090 |
| 7.400000 | 1.084090 |
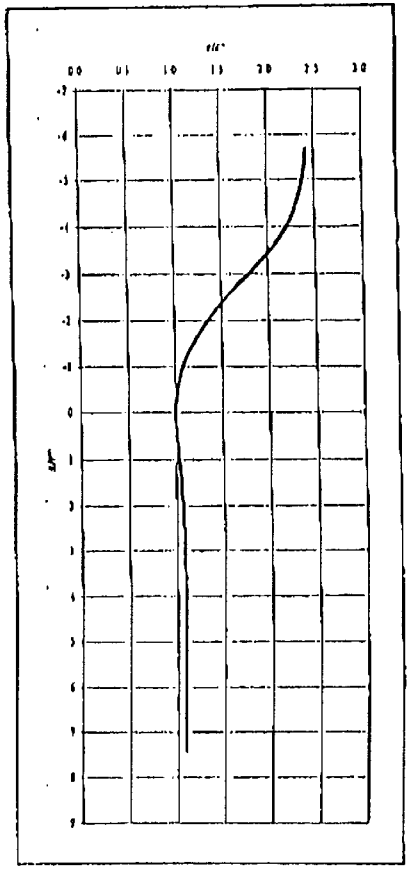
II Nozzle profile
| | | |
|---|---|---|
| Type of nozzle | | S - Short |
| Dimensionless lenght of nozzle | $L/r^*$ | 11.40 |
| Mach inlet | $M_{in}$ | 0.1 |
| Mach outlet | $M_{out}$ | 1.5 |
| Ratio between inlet temp. and outlet temp. | $T_{in}/T_{out}$ | 1.447 |
| Ratio between inlet pressure and outlet press. | $P_{in}/P_{out}$ | 3.6454486 |
x - position in axial direction
r - nozzle profile radius
r* - nozzle throat radius
| x/r* | r/r* |
|---|---|
| -5.000000 | 2.441300 |
| -4.884850 | 2.440450 |
| -4.769700 | 2.434490 |
| -4.654550 | 2.428280 |
| -4.539390 | 2.421610 |
| -4.424240 | 2.414250 |
| -4.309090 | 2.405980 |
| -4.193940 | 2.396590 |
| -4.078790 | 2.385860 |
| -3.963640 | 2.373540 |
| -3.848480 | 2.358890 |
| -3.733330 | 2.340900 |
| -3.618180 | 2.318530 |
| -3.503030 | 2.290750 |
| -3.387880 | 2.256520 |
| -3.272730 | 2.214850 |
| -3.157580 | 2.165680 |
| -3.042420 | 2.110040 |
| -2.927270 | 2.049050 |
| -2.812120 | 1.983810 |
| -2.696970 | 1.915420 |
| -2.581820 | 1.844990 |
| -2.466670 | 1.773700 |
| -2.351520 | 1.702670 |
| -2.236360 | 1.633080 |
| x/r* | r/r* |
|---|---|
| -2.121210 | 1.565950 |
| -2.006060 | 1.501780 |
| -1.890910 | 1.440980 |
| -1.775760 | 1.383920 |
| -1.660610 | 1.330840 |
| -1.545450 | 1.281790 |
| -1.430300 | 1.236810 |
| -1.315150 | 1.195920 |
| -1.200000 | 1.159100 |
| -1.084850 | 1.126350 |
| -0.969697 | 1.097630 |
| -0.854545 | 1.072940 |
| -0.739394 | 1.052210 |
| -0.624242 | 1.035340 |
| -0.509091 | 1.022170 |
| -0.393939 | 1.012440 |
| -0.278788 | 1.005810 |
| -0.163636 | 1.001860 |
| -0.048485 | 1.000150 |
| 0.066667 | 1.000260 |
| 0.181818 | 1.001820 |
| 0.296970 | 1.004490 |
| 0.412121 | 1.007990 |
| 0.527273 | 1.012060 |
| 0.642424 | 1.016530 |
| x/r* | r/r* |
|---|---|
| 0.757576 | 1.021220 |
| 0.872727 | 1.026000 |
| 0.987879 | 1.030770 |
| 1.103030 | 1.035460 |
| 1.218180 | 1.039980 |
| 1.333330 | 1.044300 |
| 1.448480 | 1.048390 |
| 1.563640 | 1.052210 |
| 1.678790 | 1.055760 |
| 1.793940 | 1.059030 |
| 1.909090 | 1.062010 |
| 2.024240 | 1.064730 |
| 2.139390 | 1.067170 |
| 2.254550 | 1.069370 |
| 2.369700 | 1.071320 |
| 2.484850 | 1.073050 |
| 2.600000 | 1.074580 |
| 2.715150 | 1.075920 |
| 2.830300 | 1.077100 |
| 2.945450 | 1.078120 |
| 3.060610 | 1.079010 |
| 3.175760 | 1.079770 |
| 3.290910 | 1.080430 |
| 3.406060 | 1.081000 |
| 3.521210 | 1.081480 |
| x/r* | r/r* |
|---|---|
| 3.636360 | 1.081900 |
| 3.751520 | 1.082260 |
| 3.866670 | 1.082560 |
| 3.981820 | 1.082810 |
| 4.096970 | 1.083030 |
| 4.212120 | 1.083210 |
| 4.327270 | 1.083360 |
| 4.442420 | 1.083490 |
| 4.557580 | 1.083590 |
| 4.672730 | 1.083680 |
| 4.787880 | 1.083750 |
| 4.903030 | 1.083810 |
| 5.018180 | 1.083850 |
| 5.133330 | 1.083880 |
| 5.248480 | 1.083910 |
| 5.363640 | 1.083930 |
| 5.478790 | 1.083950 |
| 5.593940 | 1.083960 |
| 5.709090 | 1.083960 |
| 5.824240 | 1.083970 |
| 5.939390 | 1.083970 |
| 6.054550 | 1.083970 |
| 6.169700 | 1.083970 |
| 6.284850 | 1.083970 |
| 6.400000 | 1.083970 |
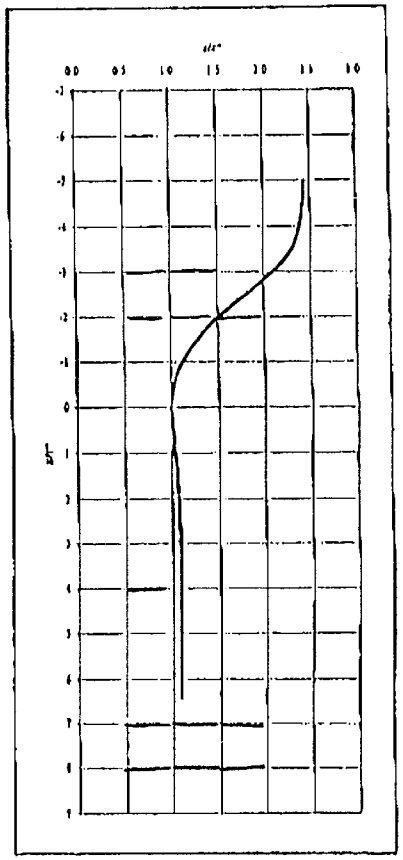
III Nozzle profile
| | | |
|---|---|---|
| Type of nozzle | | L - Long |
| Dimensionless lenght of nozzle | $L/r^*$ | 16.70 |
| Mach inlet | $M_{in}$ | 0.1 |
| Mach outlet | $M_{out}$ | 1.8 |
| Ratio between inlet temp. and outlet temp. | $T_{in}/T_{out}$ | 1.645 |
| Ratio between inlet pressure and outlet press. | $P_{in}/P_{out}$ | 5.7057561 |
x - position in axial direction
r - nozzle profile radius
$r^*$ - nozzle throat radius
| x/r* | r/r* |
|---|---|
| -7.000000 | 2.402590 |
| -6.831310 | 2.395350 |
| -6.662630 | 2.387000 |
| -6.493940 | 2.377900 |
| -6.325250 | 2.367670 |
| -6.156570 | 2.355900 |
| -5.987880 | 2.342200 |
| -5.819190 | 2.326190 |
| -5.650510 | 2.307470 |
| -5.481820 | 2.285660 |
| -5.313130 | 2.260350 |
| -5.144440 | 2.231190 |
| -4.975760 | 2.197760 |
| -4.807070 | 2.159690 |
| -4.638380 | 2.116650 |
| -4.469700 | 2.068920 |
| -4.301010 | 2.017150 |
| -4.132320 | 1.962030 |
| -3.963640 | 1.904200 |
| -3.794950 | 1.844360 |
| -3.626260 | 1.783210 |
| -3.457580 | 1.721480 |
| -3.288890 | 1.659900 |
| -3.120200 | 1.599200 |
| -2.951520 | 1.539950 |
| x/r* | r/r* |
|---|---|
| -2.782830 | 1.482580 |
| -2.614140 | 1.427510 |
| -2.445450 | 1.375120 |
| -2.276770 | 1.325620 |
| -2.108080 | 1.279220 |
| -1.939390 | 1.236070 |
| -1.770710 | 1.196300 |
| -1.602020 | 1.160010 |
| -1.433330 | 1.127320 |
| -1.264650 | 1.098300 |
| -1.095960 | 1.073030 |
| -0.927273 | 1.051550 |
| -0.758586 | 1.033910 |
| -0.589899 | 1.020070 |
| -0.421212 | 1.009970 |
| -0.252525 | 1.003470 |
| -0.083838 | 1.000370 |
| 0.084849 | 1.000360 |
| 0.253535 | 1.003100 |
| 0.422222 | 1.008180 |
| 0.590909 | 1.015180 |
| 0.759596 | 1.023670 |
| 0.928283 | 1.033250 |
| 1.096970 | 1.043570 |
| 1.265660 | 1.054320 |
| x/r* | r/r* |
|---|---|
| 1.434340 | 1.065230 |
| 1.603030 | 1.076100 |
| 1.771720 | 1.086740 |
| 1.940400 | 1.097030 |
| 2.109090 | 1.106870 |
| 2.277780 | 1.116180 |
| 2.446460 | 1.124910 |
| 2.615150 | 1.133040 |
| 2.783840 | 1.140540 |
| 2.952530 | 1.147420 |
| 3.121210 | 1.153690 |
| 3.289900 | 1.159370 |
| 3.458590 | 1.164470 |
| 3.627270 | 1.169040 |
| 3.795960 | 1.173100 |
| 3.964650 | 1.176700 |
| 4.133330 | 1.179860 |
| 4.302020 | 1.182630 |
| 4.470710 | 1.185050 |
| 4.639390 | 1.187140 |
| 4.808080 | 1.188960 |
| 4.976770 | 1.190520 |
| 5.145450 | 1.191860 |
| 5.314140 | 1.193010 |
| 5.482830 | 1.194000 |
| x/r* | r/r* |
|---|---|
| 5.651520 | 1.194830 |
| 5.820200 | 1.195540 |
| 5.988890 | 1.196140 |
| 6.157580 | 1.196650 |
| 6.326260 | 1.197070 |
| 6.494950 | 1.197410 |
| 6.663640 | 1.197700 |
| 6.832320 | 1.197940 |
| 7.001010 | 1.198140 |
| 7.169700 | 1.198300 |
| 7.338380 | 1.198420 |
| 7.507070 | 1.198500 |
| 7.675760 | 1.198570 |
| 7.844440 | 1.198640 |
| 8.013130 | 1.198690 |
| 8.181820 | 1.198720 |
| 8.350510 | 1.198740 |
| 8.519190 | 1.198740 |
| 8.687880 | 1.198750 |
| 8.856570 | 1.198760 |
| 9.025250 | 1.198770 |
| 9.193940 | 1.198770 |
| 9.362630 | 1.198770 |
| 9.531310 | 1.198770 |
| 9.700000 | 1.198770 |
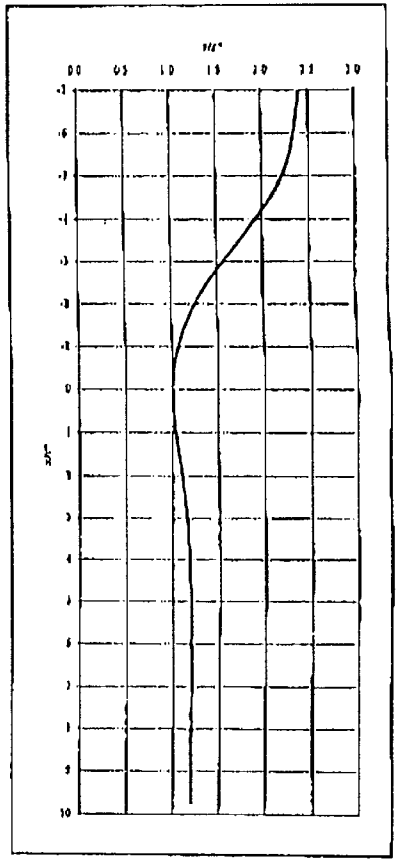
IV Nozzle profile
| | | |
|---|---|---|
| Type of nozzle | | M - Medium |
| Dimensionless lenght of nozzle | $L/r^*$ | 13.60 |
| Mach inlet | $M_{in}$ | 0.1 |
| Mach outlet | $M_{out}$ | 1.8 |
| Ratio between inlet temp. and outlet temp. | $T_{in}/T_{out}$ | 1.645 |
| Ratio between inlet pressure and outlet press. | $P_{in}/P_{out}$ | 5.7057561 |
x - position in axial direction
r - nozzle profile radius
r* - nozzle throat radius
| x/r* | r/r* |
|---|---|
| -5.700000 | 2.422050 |
| -5.562630 | 2.417440 |
| -5.425250 | 2.411090 |
| -5.287880 | 2.404220 |
| -5.150510 | 2.396540 |
| -5.013130 | 2.387750 |
| -4.875760 | 2.377560 |
| -4.738380 | 2.365670 |
| -4.601010 | 2.351780 |
| -4.463640 | 2.335370 |
| -4.326260 | 2.315720 |
| -4.188890 | 2.292070 |
| -4.051520 | 2.263700 |
| -3.914140 | 2.229860 |
| -3.776770 | 2.189840 |
| -3.639390 | 2.143650 |
| -3.502020 | 2.092020 |
| -3.364650 | 2.035720 |
| -3.227270 | 1.975510 |
| -3.089900 | 1.912160 |
| -2.952530 | 1.846570 |
| -2.815150 | 1.779720 |
| -2.677780 | 1.712620 |
| -2.540400 | 1.646270 |
| -2.403030 | 1.581470 |
| x/r* | r/r* |
|---|---|
| -2.265660 | 1.518770 |
| -2.128280 | 1.458700 |
| -1.990910 | 1.401730 |
| -1.853540 | 1.348110 |
| -1.716160 | 1.298010 |
| -1.578790 | 1.251580 |
| -1.441410 | 1.208910 |
| -1.304040 | 1.170080 |
| -1.166670 | 1.135140 |
| -1.029290 | 1.104170 |
| -0.891919 | 1.077230 |
| -0.754545 | 1.054380 |
| -0.617172 | 1.035630 |
| -0.479798 | 1.020980 |
| -0.342424 | 1.010350 |
| -0.205051 | 1.003570 |
| -0.067677 | 1.000370 |
| 0.069697 | 1.000380 |
| 0.207071 | 1.003140 |
| 0.344444 | 1.008200 |
| 0.481818 | 1.015060 |
| 0.619192 | 1.023290 |
| 0.756566 | 1.032500 |
| 0.893939 | 1.042350 |
| 1.031310 | 1.052560 |
| x/r* | r/r* |
|---|---|
| 1.168690 | 1.062900 |
| 1.306060 | 1.073210 |
| 1.443430 | 1.083320 |
| 1.580810 | 1.093140 |
| 1.718180 | 1.102570 |
| 1.855560 | 1.111550 |
| 1.992930 | 1.120050 |
| 2.130300 | 1.128020 |
| 2.267680 | 1.135460 |
| 2.405050 | 1.142350 |
| 2.542420 | 1.148700 |
| 2.679800 | 1.154510 |
| 2.817170 | 1.159810 |
| 2.954550 | 1.164610 |
| 3.091920 | 1.168940 |
| 3.229290 | 1.172820 |
| 3.366670 | 1.176280 |
| 3.504040 | 1.179350 |
| 3.641410 | 1.182060 |
| 3.778790 | 1.184440 |
| 3.916160 | 1.186530 |
| 4.053540 | 1.188350 |
| 4.190910 | 1.189920 |
| 4.328280 | 1.191290 |
| 4.465660 | 1.192460 |
| x/r* | r/r* |
|---|---|
| 4.603030 | 1.193470 |
| 4.740400 | 1.194330 |
| 4.877780 | 1.195060 |
| 5.015150 | 1.195690 |
| 5.152530 | 1.196220 |
| 5.289900 | 1.196650 |
| 5.427270 | 1.197010 |
| 5.564650 | 1.197310 |
| 5.702020 | 1.197570 |
| 5.839390 | 1.197790 |
| 5.976770 | 1.197960 |
| 6.114140 | 1.198090 |
| 6.251520 | 1.198200 |
| 6.388890 | 1.198300 |
| 6.526260 | 1.198380 |
| 6.663640 | 1.198430 |
| 6.801010 | 1.198470 |
| 6.938380 | 1.198490 |
| 7.075760 | 1.198500 |
| 7.213130 | 1.198520 |
| 7.350510 | 1.198540 |
| 7.487880 | 1.198550 |
| 7.625250 | 1.198550 |
| 7.762630 | 1.198550 |
| 7.900000 | 1.198550 |
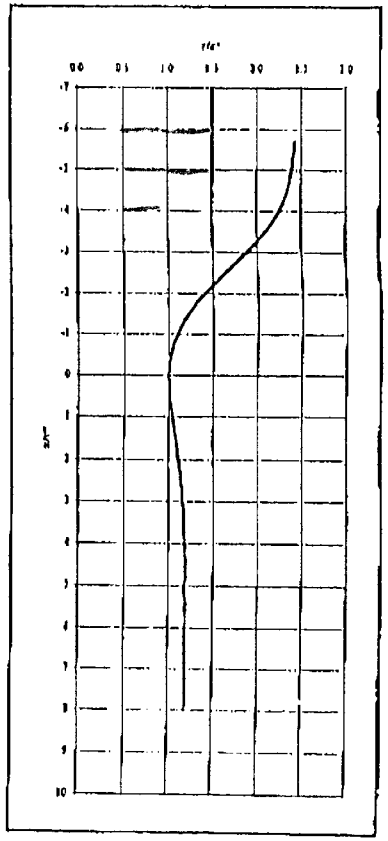
V Nozzle profile
| | | |
|---|---|---|
| Type of nozzle | | S - Short |
| Dimensionless lenght of nozzle | $L/r^*$ | 11.80 |
| Mach inlet | $M_{in}$ | 0.1 |
| Mach outlet | $M_{out}$ | 1.8 |
| Ratio between inlet temp. and outlet temp. | $T_{in}/T_{out}$ | 1.645 |
| Ratio between inlet pressure and outlet press. | $P_{in}/P_{out}$ | 5.7057561 |
x - position in axial direction
r - nozzle profile radius
r* - nozzle throat radius
| x/r* | r/r* |
|---|---|
| -4.900000 | 2.439530 |
| -4.780810 | 2.436000 |
| -4.661620 | 2.431080 |
| -4.542420 | 2.426490 |
| -4.423230 | 2.421180 |
| -4.304040 | 2.415310 |
| -4.184850 | 2.408710 |
| -4.065660 | 2.401250 |
| -3.946460 | 2.392740 |
| -3.827270 | 2.382470 |
| -3.708080 | 2.369250 |
| -3.588890 | 2.351880 |
| -3.469700 | 2.329170 |
| -3.350510 | 2.299910 |
| -3.231310 | 2.262970 |
| -3.112120 | 2.218210 |
| -2.992930 | 2.166400 |
| -2.873740 | 2.108310 |
| -2.754550 | 2.044730 |
| -2.635350 | 1.976470 |
| -2.516160 | 1.904680 |
| -2.396970 | 1.830840 |
| -2.277780 | 1.756380 |
| -2.158590 | 1.682780 |
| -2.039390 | 1.611130 |
| x/r* | r/r* |
|---|---|
| -1.920200 | 1.542110 |
| -1.801010 | 1.476390 |
| -1.681820 | 1.414530 |
| -1.562630 | 1.356770 |
| -1.443430 | 1.303220 |
| -1.324240 | 1.253990 |
| -1.205050 | 1.209080 |
| -1.085860 | 1.168500 |
| -0.966667 | 1.132270 |
| -0.847475 | 1.100400 |
| -0.728283 | 1.072950 |
| -0.609091 | 1.049970 |
| -0.489899 | 1.031470 |
| -0.370707 | 1.017410 |
| -0.251515 | 1.007680 |
| -0.132323 | 1.002020 |
| -0.013131 | 1.000020 |
| 0.106061 | 1.001150 |
| 0.225253 | 1.004860 |
| 0.344444 | 1.010600 |
| 0.463636 | 1.017860 |
| 0.582828 | 1.026240 |
| 0.702020 | 1.035360 |
| 0.821212 | 1.044960 |
| 0.940404 | 1.054790 |
| x/r* | r/r* |
|---|---|
| 1.059600 | 1.064680 |
| 1.178790 | 1.074480 |
| 1.297980 | 1.084080 |
| 1.417170 | 1.093390 |
| 1.536360 | 1.102350 |
| 1.655560 | 1.110900 |
| 1.774750 | 1.119010 |
| 1.893940 | 1.126650 |
| 2.013130 | 1.133810 |
| 2.132320 | 1.140490 |
| 2.251520 | 1.146680 |
| 2.370710 | 1.152390 |
| 2.489900 | 1.157630 |
| 2.609090 | 1.162420 |
| 2.728280 | 1.166760 |
| 2.847470 | 1.170690 |
| 2.966670 | 1.174230 |
| 3.085860 | 1.177390 |
| 3.205050 | 1.180210 |
| 3.324240 | 1.182710 |
| 3.443430 | 1.184920 |
| 3.562630 | 1.186860 |
| 3.681820 | 1.188550 |
| 3.801010 | 1.190030 |
| 3.920200 | 1.191310 |
| x/r* | r/r* |
|---|---|
| 4.039390 | 1.192410 |
| 4.158590 | 1.193360 |
| 4.277780 | 1.194160 |
| 4.396970 | 1.194860 |
| 4.516160 | 1.195450 |
| 4.635350 | 1.195950 |
| 4.754550 | 1.196350 |
| 4.873740 | 1.196700 |
| 4.992930 | 1.197000 |
| 5.112120 | 1.197250 |
| 5.231310 | 1.197450 |
| 5.350510 | 1.197610 |
| 5.469700 | 1.197750 |
| 5.588890 | 1.197870 |
| 5.708080 | 1.197970 |
| 5.827270 | 1.198040 |
| 5.946460 | 1.198080 |
| 6.065660 | 1.198110 |
| 6.184850 | 1.198140 |
| 6.304040 | 1.198170 |
| 6.423230 | 1.198200 |
| 6.542420 | 1.198210 |
| 6.661620 | 1.198210 |
| 6.780810 | 1.198210 |
| 6.900000 | 1.198210 |
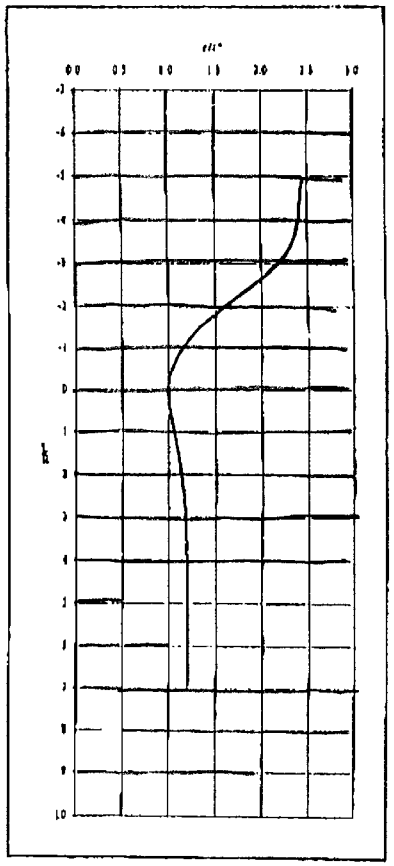
VI Nozzle profile
| | | |
|---|---|---|
| Type of nozzle | | L - Long |
| Dimensionless lenght of nozzle | $L/r^*$ | 17.70 |
| Mach inlet | $M_{in}$ | 0.1 |
| Mach outlet | $M_{out}$ | 2.0 |
| Ratio between inlet temp. and outlet temp. | $T_{in}/T_{out}$ | 1.796 |
| Ratio between inlet pressure and outlet press. | $P_{in}/P_{out}$ | 7.7699235 |
x - position in axial direction
r - nozzle profile radius
r* - nozzle throat radius
| x/r* | r/r* |
|---|---|
| -7.000000 | 2.404000 |
| -6.821210 | 2.397180 |
| -6.642420 | 2.388970 |
| -6.463640 | 2.379940 |
| -6.284850 | 2.369650 |
| -6.106060 | 2.357660 |
| -5.927270 | 2.343530 |
| -5.748480 | 2.326820 |
| -5.569700 | 2.307090 |
| -5.390910 | 2.283830 |
| -5.212120 | 2.256550 |
| -5.033330 | 2.224760 |
| -4.854550 | 2.187930 |
| -4.675760 | 2.145590 |
| -4.496970 | 2.097750 |
| -4.318180 | 2.045090 |
| -4.139390 | 1.988330 |
| -3.960610 | 1.928210 |
| -3.781820 | 1.865450 |
| -3.603030 | 1.800900 |
| -3.424240 | 1.735440 |
| -3.245450 | 1.669980 |
| -3.066670 | 1.605380 |
| -2.887880 | 1.542300 |
| -2.709090 | 1.481280 |
| x/r* | r/r* |
|---|---|
| -2.530300 | 1.422880 |
| -2.351520 | 1.367470 |
| -2.172730 | 1.315320 |
| -1.993940 | 1.266670 |
| -1.815150 | 1.221690 |
| -1.636360 | 1.180540 |
| -1.457580 | 1.143350 |
| -1.278790 | 1.110250 |
| -1.100000 | 1.081360 |
| -0.921212 | 1.056770 |
| -0.742424 | 1.036590 |
| -0.563636 | 1.020850 |
| -0.384848 | 1.009570 |
| -0.206061 | 1.002690 |
| -0.027273 | 1.000050 |
| 0.151515 | 1.001380 |
| 0.330303 | 1.006310 |
| 0.509091 | 1.014390 |
| 0.687879 | 1.025060 |
| 0.866667 | 1.037760 |
| 1.045450 | 1.051950 |
| 1.224240 | 1.067110 |
| 1.403030 | 1.082820 |
| 1.581820 | 1.098720 |
| 1.760610 | 1.114510 |
| x/r* | r/r* |
|---|---|
| 1.939390 | 1.129960 |
| 2.118180 | 1.144910 |
| 2.296970 | 1.159210 |
| 2.475760 | 1.172790 |
| 2.654550 | 1.185560 |
| 2.833330 | 1.197500 |
| 3.012120 | 1.208570 |
| 3.190910 | 1.218790 |
| 3.369700 | 1.228150 |
| 3.548480 | 1.236690 |
| 3.727270 | 1.244410 |
| 3.906060 | 1.251380 |
| 4.084850 | 1.257610 |
| 4.263640 | 1.263160 |
| 4.442420 | 1.268080 |
| 4.621210 | 1.272420 |
| 4.800000 | 1.276220 |
| 4.978790 | 1.279530 |
| 5.157580 | 1.282400 |
| 5.336360 | 1.284880 |
| 5.515150 | 1.287010 |
| 5.693940 | 1.288830 |
| 5.872730 | 1.290380 |
| 6.051520 | 1.291690 |
| 6.230300 | 1.292790 |
| x/r* | r/r* |
|---|---|
| 6.409090 | 1.293710 |
| 6.587880 | 1.294470 |
| 6.766670 | 1.295100 |
| 6.945450 | 1.295630 |
| 7.124240 | 1.296050 |
| 7.303030 | 1.296400 |
| 7.481820 | 1.296680 |
| 7.660610 | 1.296910 |
| 7.839390 | 1.297080 |
| 8.018180 | 1.297220 |
| 8.196970 | 1.297330 |
| 8.375760 | 1.297400 |
| 8.554550 | 1.297450 |
| 8.733330 | 1.297490 |
| 8.912120 | 1.297510 |
| 9.090910 | 1.297530 |
| 9.269700 | 1.297550 |
| 9.448480 | 1.297560 |
| 9.627270 | 1.297570 |
| 9.806060 | 1.297570 |
| 9.984850 | 1.297570 |
| 10.163600 | 1.297570 |
| 10.342400 | 1.297570 |
| 10.521200 | 1.297570 |
| 10.700000 | 1.297580 |
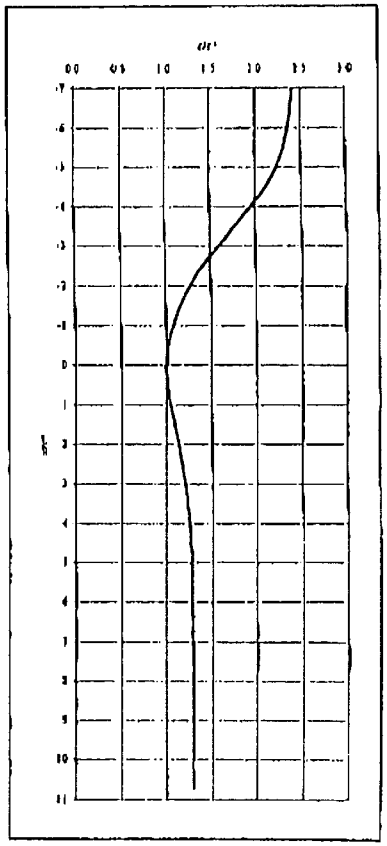
VII Nozzle profile
| | | |
|---|---|---|
| Type of nozzle | | M - Medium |
| Dimensionless lenght of nozzle | $L/r^*$ | 14.50 |
| Mach inlet | $M_{in}$ | 0.1 |
| Mach outlet | $M_{out}$ | 2.0 |
| Ratio between inlet temp. and outlet temp. | $T_{in}/T_{out}$ | 1.796 |
| Ratio between inlet pressure and outlet press. | $P_{in}/P_{out}$ | 7.7699235 |
x - position in axial direction
r - nozzle profile radius
r* - nozzle throat radius
| x/r* | r/r* |
|---|---|
| -5.700000 | 2.422290 |
| -5.553540 | 2.418110 |
| -5.407070 | 2.411920 |
| -5.260610 | 2.405180 |
| -5.114140 | 2.397560 |
| -4.967680 | 2.388740 |
| -4.821210 | 2.378390 |
| -4.674750 | 2.366180 |
| -4.528280 | 2.351720 |
| -4.381820 | 2.334220 |
| -4.235350 | 2.312750 |
| -4.088890 | 2.286380 |
| -3.942420 | 2.254200 |
| -3.795960 | 2.215280 |
| -3.649490 | 2.169270 |
| -3.503030 | 2.116860 |
| -3.356570 | 2.058870 |
| -3.210100 | 1.996100 |
| -3.063640 | 1.929380 |
| -2.917170 | 1.859770 |
| -2.770710 | 1.788500 |
| -2.624240 | 1.716820 |
| -2.477780 | 1.645940 |
| -2.331310 | 1.576770 |
| -2.184850 | 1.509990 |
| x/r* | r/r* |
|---|---|
| -2.038380 | 1.446310 |
| -1.891920 | 1.386210 |
| -1.745450 | 1.329930 |
| -1.598990 | 1.277710 |
| -1.452530 | 1.229680 |
| -1.306060 | 1.185950 |
| -1.159600 | 1.146610 |
| -1.013130 | 1.111750 |
| -0.866667 | 1.081480 |
| -0.720202 | 1.055910 |
| -0.573737 | 1.035130 |
| -0.427273 | 1.019200 |
| -0.280808 | 1.008130 |
| -0.134343 | 1.001810 |
| 0.012121 | 1.000010 |
| 0.158586 | 1.002340 |
| 0.305051 | 1.008260 |
| 0.451515 | 1.017120 |
| 0.597980 | 1.028290 |
| 0.744444 | 1.041130 |
| 0.890909 | 1.055100 |
| 1.037370 | 1.069760 |
| 1.183840 | 1.084750 |
| 1.330300 | 1.099770 |
| 1.476770 | 1.114620 |
| x/r* | r/r* |
|---|---|
| 1.623230 | 1.129120 |
| 1.769700 | 1.143140 |
| 1.916160 | 1.156580 |
| 2.062630 | 1.169390 |
| 2.209090 | 1.181500 |
| 2.355560 | 1.192890 |
| 2.502020 | 1.203550 |
| 2.648480 | 1.213460 |
| 2.794950 | 1.222640 |
| 2.941410 | 1.231090 |
| 3.087880 | 1.238840 |
| 3.234340 | 1.245900 |
| 3.380810 | 1.252310 |
| 3.527270 | 1.258090 |
| 3.673740 | 1.263290 |
| 3.820200 | 1.267930 |
| 3.966670 | 1.272050 |
| 4.113130 | 1.275690 |
| 4.259600 | 1.278900 |
| 4.406060 | 1.281700 |
| 4.552530 | 1.284140 |
| 4.698990 | 1.286250 |
| 4.845450 | 1.288060 |
| 4.991920 | 1.289620 |
| 5.138380 | 1.290940 |
| x/r* | r/r* |
|---|---|
| 5.284850 | 1.292060 |
| 5.431310 | 1.293010 |
| 5.577780 | 1.293800 |
| 5.724240 | 1.294460 |
| 5.870710 | 1.295020 |
| 6.017170 | 1.295480 |
| 6.163640 | 1.295860 |
| 6.310100 | 1.296170 |
| 6.456570 | 1.296430 |
| 6.603030 | 1.296630 |
| 6.749490 | 1.296790 |
| 6.895960 | 1.296910 |
| 7.042420 | 1.297000 |
| 7.188890 | 1.297070 |
| 7.335350 | 1.297120 |
| 7.481820 | 1.297160 |
| 7.628280 | 1.297190 |
| 7.774750 | 1.297220 |
| 7.921210 | 1.297230 |
| 8.067680 | 1.297240 |
| 8.214140 | 1.297240 |
| 8.360610 | 1.297250 |
| 8.507070 | 1.297250 |
| 8.653540 | 1.297250 |
| 8.800000 | 1.297260 |
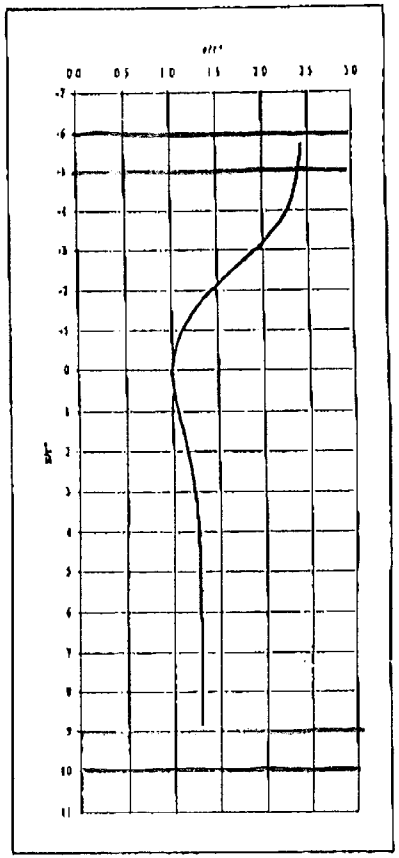
VIII Nozzle profile
| | | |
|---|---|---|
| Type of nozzle | | S - Short |
| Dimensionless lenght of nozzle | $L/r^*$ | 12.60 |
| Mach inlet | $M_{in}$ | 0.1 |
| Mach outlet | $M_{out}$ | 2.0 |
| Ratio between inlet temp. and outlet temp. | $T_{in}/T_{out}$ | 1.796 |
| Ratio between inlet pressure and outlet press. | $P_{in}/P_{out}$ | 7.7699235 |
x - position in axial direction
r - nozzle profile radius
r* - nozzle throat radius
| x/r* | r/r* |
|---|---|
| -4.900000 | 2.438450 |
| -4.772730 | 2.435440 |
| -4.645450 | 2.431030 |
| -4.518180 | 2.426380 |
| -4.390910 | 2.421320 |
| -4.263640 | 2.415700 |
| -4.136360 | 2.409380 |
| -4.009090 | 2.402200 |
| -3.881820 | 2.393840 |
| -3.754550 | 2.383120 |
| -3.627270 | 2.368570 |
| -3.500000 | 2.348750 |
| -3.372730 | 2.322200 |
| -3.245450 | 2.287490 |
| -3.118180 | 2.243950 |
| -2.990910 | 2.192230 |
| -2.863640 | 2.133070 |
| -2.736360 | 2.067240 |
| -2.609090 | 1.995540 |
| -2.481820 | 1.919380 |
| -2.354550 | 1.840570 |
| -2.227270 | 1.760930 |
| -2.100000 | 1.682220 |
| -1.972730 | 1.605610 |
| -1.845450 | 1.532040 |
| x/r* | r/r* |
|---|---|
| -1.718180 | 1.462390 |
| -1.590910 | 1.397190 |
| -1.463640 | 1.336670 |
| -1.336360 | 1.281010 |
| -1.209090 | 1.230240 |
| -1.081820 | 1.184380 |
| -0.954545 | 1.143440 |
| -0.827273 | 1.107480 |
| -0.700000 | 1.076570 |
| -0.572727 | 1.050820 |
| -0.445455 | 1.030330 |
| -0.318182 | 1.015160 |
| -0.190909 | 1.005300 |
| -0.063636 | 1.000570 |
| 0.063636 | 1.000540 |
| 0.190909 | 1.004580 |
| 0.318182 | 1.011930 |
| 0.445455 | 1.021800 |
| 0.572727 | 1.033500 |
| 0.700000 | 1.046440 |
| 0.827273 | 1.060170 |
| 0.954545 | 1.074320 |
| 1.081820 | 1.088610 |
| 1.209090 | 1.102830 |
| 1.336360 | 1.116820 |
| x/r* | r/r* |
|---|---|
| 1.463640 | 1.130450 |
| 1.590910 | 1.143630 |
| 1.718180 | 1.156290 |
| 1.845450 | 1.168370 |
| 1.972730 | 1.179830 |
| 2.100000 | 1.190660 |
| 2.227270 | 1.200850 |
| 2.354550 | 1.210370 |
| 2.481820 | 1.219250 |
| 2.609090 | 1.227490 |
| 2.736360 | 1.235090 |
| 2.863640 | 1.242080 |
| 2.990910 | 1.248480 |
| 3.118180 | 1.254310 |
| 3.245450 | 1.259600 |
| 3.372730 | 1.264380 |
| 3.500000 | 1.268660 |
| 3.627270 | 1.272490 |
| 3.754550 | 1.275890 |
| 3.881820 | 1.278900 |
| 4.009090 | 1.281540 |
| 4.136360 | 1.283850 |
| 4.263640 | 1.285860 |
| 4.390910 | 1.287600 |
| 4.518180 | 1.289100 |
| x/r* | r/r* |
|---|---|
| 4.645450 | 1.290390 |
| 4.772730 | 1.291490 |
| 4.900000 | 1.292420 |
| 5.027270 | 1.293200 |
| 5.154550 | 1.293870 |
| 5.281820 | 1.294420 |
| 5.409090 | 1.294890 |
| 5.536360 | 1.295270 |
| 5.663640 | 1.295590 |
| 5.790910 | 1.295850 |
| 5.918180 | 1.296060 |
| 6.045450 | 1.296220 |
| 6.172730 | 1.296350 |
| 6.300000 | 1.296460 |
| 6.427270 | 1.296540 |
| 6.554550 | 1.296600 |
| 6.681820 | 1.296650 |
| 6.809090 | 1.296680 |
| 6.936360 | 1.296710 |
| 7.063640 | 1.296720 |
| 7.190910 | 1.296740 |
| 7.318180 | 1.296740 |
| 7.445450 | 1.296750 |
| 7.572730 | 1.296760 |
| 7.700000 | 1.296760 |
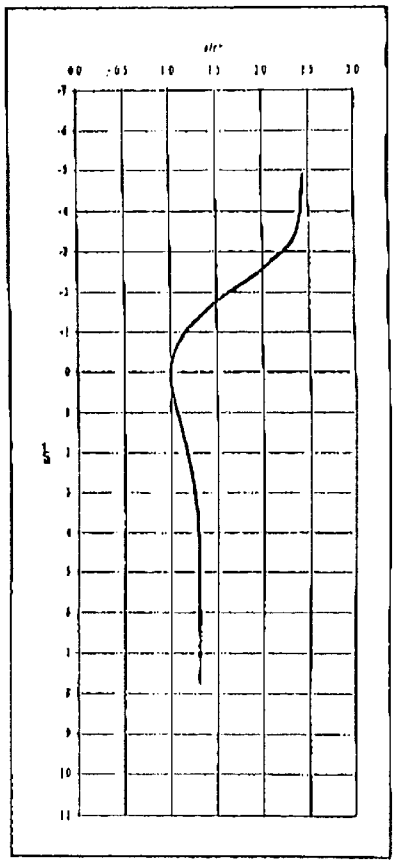
IX Nozzle profile
| | | |
|---|---|---|
| Type of nozzle | | L - Long |
| Dimensionless lenght of nozzle | $L/r^*$ | 19.50 |
| Mach inlet | $M_{in}$ | 0.1 |
| Mach outlet | $M_{out}$ | 2.3 |
| Ratio between inlet temp. and outlet temp. | $T_{in}/T_{out}$ | 2.054 |
| Ratio between inlet pressure and outlet press. | $P_{in}/P_{out}$ | 12.417146 |
x - position in axial direction
r - nozzle profile radius
r* - nozzle throat radius
| x/r* | r/r* |
|---|---|
| -7.000000 | 2.405040 |
| -6.803030 | 2.398210 |
| -6.606060 | 2.389680 |
| -6.409090 | 2.380140 |
| -6.212120 | 2.369010 |
| -6.015150 | 2.355750 |
| -5.818180 | 2.339800 |
| -5.621210 | 2.320610 |
| -5.424240 | 2.297510 |
| -5.227270 | 2.269790 |
| -5.030300 | 2.236750 |
| -4.833330 | 2.197680 |
| -4.636360 | 2.151890 |
| -4.439390 | 2.099490 |
| -4.242420 | 2.041350 |
| -4.045450 | 1.978350 |
| -3.848480 | 1.911360 |
| -3.651520 | 1.841390 |
| -3.454550 | 1.769630 |
| -3.257580 | 1.697300 |
| -3.060610 | 1.625590 |
| -2.863640 | 1.555450 |
| -2.666670 | 1.487650 |
| -2.469700 | 1.422950 |
| -2.272730 | 1.361840 |
| x/r* | r/r* |
|---|---|
| -2.075760 | 1.304700 |
| -1.878790 | 1.251830 |
| -1.681820 | 1.203460 |
| -1.484850 | 1.159780 |
| -1.287880 | 1.121000 |
| -1.090910 | 1.087290 |
| -0.893939 | 1.058850 |
| -0.696970 | 1.035850 |
| -0.500000 | 1.018440 |
| -0.303030 | 1.006750 |
| -0.106061 | 1.000820 |
| 0.090909 | 1.000600 |
| 0.287879 | 1.005870 |
| 0.484848 | 1.016250 |
| 0.681818 | 1.031120 |
| 0.878788 | 1.049690 |
| 1.075760 | 1.071050 |
| 1.272730 | 1.094320 |
| 1.469700 | 1.118720 |
| 1.666670 | 1.143590 |
| 1.863640 | 1.168420 |
| 2.060610 | 1.192850 |
| 2.257580 | 1.216570 |
| 2.454550 | 1.239390 |
| 2.651520 | 1.261160 |
| x/r* | r/r* |
|---|---|
| 2.848480 | 1.281790 |
| 3.045450 | 1.301200 |
| 3.242420 | 1.319380 |
| 3.439390 | 1.336300 |
| 3.636360 | 1.351970 |
| 3.833330 | 1.366420 |
| 4.030300 | 1.379670 |
| 4.227270 | 1.391760 |
| 4.424240 | 1.402730 |
| 4.621210 | 1.412640 |
| 4.818180 | 1.421530 |
| 5.015150 | 1.429480 |
| 5.212120 | 1.436530 |
| 5.409090 | 1.442750 |
| 5.606060 | 1.448200 |
| 5.803030 | 1.452950 |
| 6.000000 | 1.457050 |
| 6.196970 | 1.460590 |
| 6.393940 | 1.463610 |
| 6.590910 | 1.466160 |
| 6.787880 | 1.468310 |
| 6.984850 | 1.470130 |
| 7.181820 | 1.471650 |
| 7.378790 | 1.472910 |
| 7.575760 | 1.473940 |
| x/r* | r/r* |
|---|---|
| 7.772730 | 1.474790 |
| 7.969700 | 1.475470 |
| 8.166670 | 1.476030 |
| 8.363640 | 1.476460 |
| 8.560610 | 1.476790 |
| 8.757580 | 1.477020 |
| 8.954550 | 1.477200 |
| 9.151520 | 1.477350 |
| 9.348480 | 1.477460 |
| 9.545450 | 1.477550 |
| 9.742420 | 1.477610 |
| 9.939390 | 1.477640 |
| 10.136400 | 1.477660 |
| 10.333300 | 1.477670 |
| 10.530300 | 1.477680 |
| 10.727300 | 1.477700 |
| 10.924200 | 1.477710 |
| 11.121200 | 1.477710 |
| 11.318200 | 1.477710 |
| 11.515200 | 1.477710 |
| 11.712100 | 1.477710 |
| 11.909100 | 1.477710 |
| 12.106100 | 1.477720 |
| 12.303000 | 1.477720 |
| 12.500000 | 1.477720 |
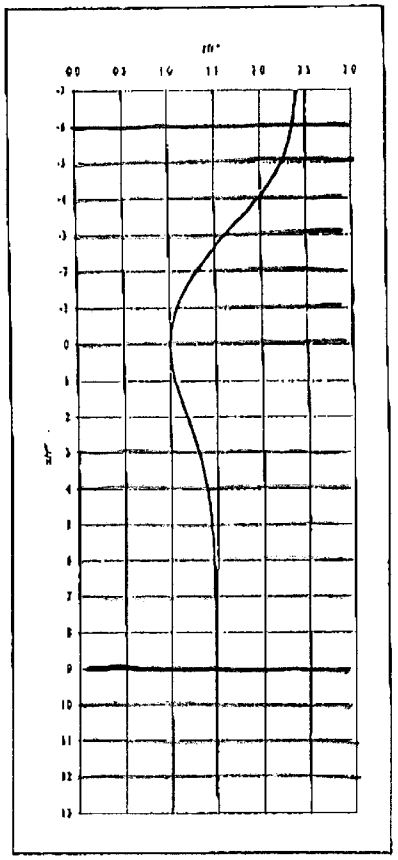
X Nozzle profile
| | | |
|---|---|---|
| Type of nozzle | | M - Medium |
| Dimensionless lenght of nozzle | $L/r^*$ | 16.00 |
| Mach inlet | $M_{in}$ | 0.1 |
| Mach outlet | $M_{out}$ | 2.3 |
| Ratio between inlet temp. and outlet temp. | $T_{in}/T_{out}$ | 2.054 |
| Ratio between inlet pressure and outlet press. | $P_{in}/P_{out}$ | 12.417146 |
x - position in axial direction
r - nozzle profile radius
r* - nozzle throat radius
| x/r* | r/r* |
|---|---|
| -5.700000 | 2.422270 |
| -5.538380 | 2.418210 |
| -5.376770 | 2.411880 |
| -5.215150 | 2.404870 |
| -5.053540 | 2.396800 |
| -4.891920 | 2.387260 |
| -4.730300 | 2.375850 |
| -4.568690 | 2.362150 |
| -4.407070 | 2.345320 |
| -4.245450 | 2.324120 |
| -4.083840 | 2.297270 |
| -3.922220 | 2.263520 |
| -3.760610 | 2.221620 |
| -3.598990 | 2.171250 |
| -3.437370 | 2.113270 |
| -3.275760 | 2.048620 |
| -3.114140 | 1.978260 |
| -2.952530 | 1.903330 |
| -2.790910 | 1.825440 |
| -2.629290 | 1.746280 |
| -2.467680 | 1.667540 |
| -2.306060 | 1.590490 |
| -2.144440 | 1.516170 |
| -1.982830 | 1.445560 |
| -1.821210 | 1.379260 |
| x/r* | r/r* |
|---|---|
| -1.659600 | 1.317640 |
| -1.497980 | 1.260970 |
| -1.336360 | 1.209420 |
| -1.174750 | 1.163120 |
| -1.013130 | 1.122230 |
| -0.851515 | 1.086910 |
| -0.689899 | 1.057340 |
| -0.528283 | 1.033720 |
| -0.366667 | 1.016240 |
| -0.205051 | 1.005050 |
| -0.043434 | 1.000220 |
| 0.118182 | 1.001630 |
| 0.279798 | 1.008880 |
| 0.441414 | 1.021260 |
| 0.603030 | 1.037750 |
| 0.764646 | 1.057260 |
| 0.926263 | 1.078770 |
| 1.087880 | 1.101460 |
| 1.249490 | 1.124700 |
| 1.411110 | 1.148030 |
| 1.572730 | 1.171100 |
| 1.734340 | 1.193650 |
| 1.895960 | 1.215520 |
| 2.057580 | 1.236560 |
| 2.219190 | 1.256680 |
| x/r* | r/r* |
|---|---|
| 2.380810 | 1.275820 |
| 2.542420 | 1.293950 |
| 2.704040 | 1.311030 |
| 2.865660 | 1.327070 |
| 3.027270 | 1.342060 |
| 3.188890 | 1.356020 |
| 3.350510 | 1.368970 |
| 3.512120 | 1.380930 |
| 3.673740 | 1.391920 |
| 3.835350 | 1.402000 |
| 3.996970 | 1.411180 |
| 4.158590 | 1.419510 |
| 4.320200 | 1.427030 |
| 4.481820 | 1.433800 |
| 4.643430 | 1.439830 |
| 4.805050 | 1.445200 |
| 4.966670 | 1.449940 |
| 5.128280 | 1.454110 |
| 5.289900 | 1.457760 |
| 5.451520 | 1.460930 |
| 5.613130 | 1.463660 |
| 5.774750 | 1.466010 |
| 5.936360 | 1.468020 |
| 6.097980 | 1.469710 |
| 6.259600 | 1.471140 |
| x/r* | r/r* |
|---|---|
| 6.421210 | 1.472330 |
| 6.582830 | 1.473330 |
| 6.744440 | 1.474160 |
| 6.906060 | 1.474830 |
| 7.067680 | 1.475370 |
| 7.229290 | 1.475790 |
| 7.390910 | 1.476140 |
| 7.552530 | 1.476420 |
| 7.714140 | 1.476640 |
| 7.875760 | 1.476800 |
| 8.037370 | 1.476920 |
| 8.198990 | 1.477000 |
| 8.360610 | 1.477060 |
| 8.522220 | 1.477110 |
| 8.683840 | 1.477150 |
| 8.845450 | 1.477180 |
| 9.007070 | 1.477200 |
| 9.168690 | 1.477220 |
| 9.330300 | 1.477220 |
| 9.491920 | 1.477230 |
| 9.653540 | 1.477230 |
| 9.815150 | 1.477230 |
| 9.976770 | 1.477230 |
| 10.138400 | 1.477240 |
| 10.300000 | 1.477240 |
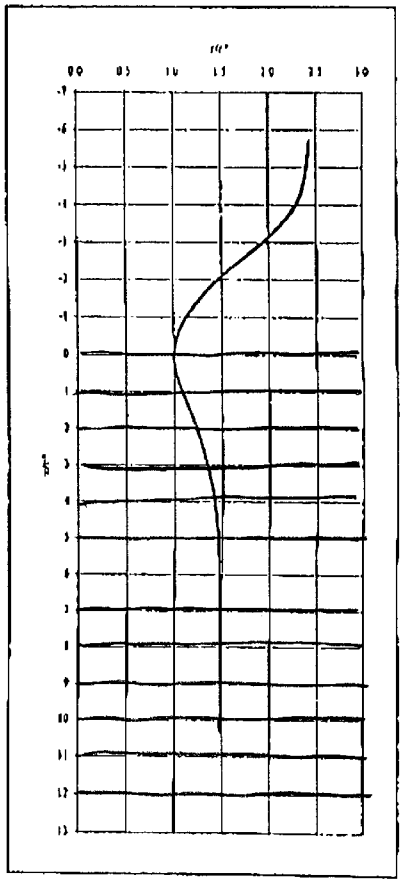
XI Nozzle profile

| | | |
|---|---|---|
| Type of nozzle | | S - Short |
| Dimensionless lenght of nozzle | $L/r^*$ | 13.80 |
| Mach inlet | $M_{in}$ | 0.1 |
| Mach outlet | $M_{out}$ | 2.3 |
| Ratio between inlet temp. and outlet temp. | $T_{in}/T_{out}$ | 2.054 |
| Ratio between inlet pressure and outlet press. | $P_{in}/P_{out}$ | 12.417146 |

x - position in axial direction
r - nozzle profile radius
r* - nozzle throat radius

| $x/r^*$ | $r/r^*$ |
|---|---|
| -4.900000 | 2.437200 |
| -4.760610 | 2.434500 |
| -4.621210 | 2.430150 |
| -4.481820 | 2.425520 |
| -4.342420 | 2.420470 |
| -4.203030 | 2.414830 |
| -4.063640 | 2.408430 |
| -3.924240 | 2.401090 |
| -3.784850 | 2.391830 |
| -3.645450 | 2.378820 |
| -3.506060 | 2.360180 |
| -3.366670 | 2.334000 |
| -3.227270 | 2.298420 |
| -3.087880 | 2.252540 |
| -2.948480 | 2.196970 |
| -2.809090 | 2.132500 |
| -2.669700 | 2.059880 |
| -2.530300 | 1.980210 |
| -2.390910 | 1.895670 |
| -2.251520 | 1.808690 |
| -2.112120 | 1.721640 |
| -1.972730 | 1.636380 |
| -1.833330 | 1.554260 |
| -1.693940 | 1.476590 |
| -1.554550 | 1.404130 |

| $x/r^*$ | $r/r^*$ |
|---|---|
| -1.415150 | 1.337230 |
| -1.275760 | 1.276130 |
| -1.136360 | 1.220880 |
| -0.996970 | 1.171480 |
| -0.857576 | 1.127980 |
| -0.718182 | 1.090490 |
| -0.578788 | 1.059180 |
| -0.439394 | 1.034260 |
| -0.300000 | 1.015980 |
| -0.160606 | 1.004550 |
| -0.021212 | 1.000080 |
| 0.118182 | 1.002360 |
| 0.257576 | 1.010710 |
| 0.396970 | 1.023970 |
| 0.536364 | 1.040810 |
| 0.675758 | 1.060020 |
| 0.815152 | 1.080690 |
| 0.954545 | 1.102160 |
| 1.093940 | 1.123950 |
| 1.233330 | 1.145720 |
| 1.372730 | 1.167200 |
| 1.512120 | 1.188220 |
| 1.651520 | 1.208640 |
| 1.790910 | 1.228350 |
| 1.930300 | 1.247280 |

| $x/r^*$ | $r/r^*$ |
|---|---|
| 2.069700 | 1.265390 |
| 2.209090 | 1.282640 |
| 2.348480 | 1.299010 |
| 2.487880 | 1.314490 |
| 2.627270 | 1.329080 |
| 2.766670 | 1.342790 |
| 2.906060 | 1.355620 |
| 3.045450 | 1.367590 |
| 3.184850 | 1.378720 |
| 3.324240 | 1.389030 |
| 3.463640 | 1.398550 |
| 3.603030 | 1.407310 |
| 3.742420 | 1.415330 |
| 3.881820 | 1.422660 |
| 4.021210 | 1.429320 |
| 4.160610 | 1.435330 |
| 4.300000 | 1.440750 |
| 4.439390 | 1.445620 |
| 4.578790 | 1.449960 |
| 4.718180 | 1.453810 |
| 4.857580 | 1.457200 |
| 4.996970 | 1.460180 |
| 5.136360 | 1.462780 |
| 5.275760 | 1.465020 |
| 5.415150 | 1.466950 |

| $x/r^*$ | $r/r^*$ |
|---|---|
| 5.554550 | 1.468600 |
| 5.693940 | 1.470010 |
| 5.833330 | 1.471220 |
| 5.972730 | 1.472230 |
| 6.112120 | 1.473070 |
| 6.251520 | 1.473760 |
| 6.390910 | 1.474330 |
| 6.530300 | 1.474800 |
| 6.669700 | 1.475190 |
| 6.809090 | 1.475490 |
| 6.948480 | 1.475730 |
| 7.087880 | 1.475900 |
| 7.227270 | 1.476040 |
| 7.366670 | 1.476140 |
| 7.506060 | 1.476230 |
| 7.645450 | 1.476310 |
| 7.784850 | 1.476360 |
| 7.924240 | 1.476400 |
| 8.063640 | 1.476420 |
| 8.203030 | 1.476440 |
| 8.342420 | 1.476450 |
| 8.481820 | 1.476460 |
| 8.621210 | 1.476460 |
| 8.760610 | 1.476470 |
| 8.900000 | 1.476480 |

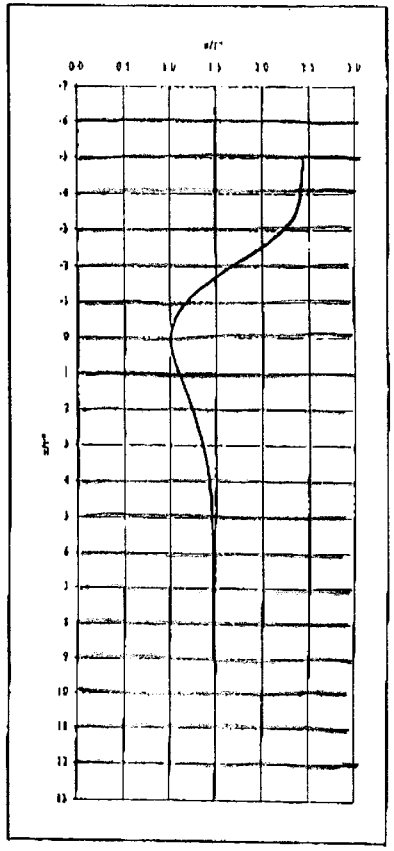

XII

Nozzle profile
| | | |
|---|---|---|
| Type of nozzle | | L - Long |
| Dimensionless lenght of nozzle | $L/r^*$ | 21.30 |
| Mach inlet | $M_{in}$ | 0.1 |
| Mach outlet | $M_{out}$ | 2.5 |
| Ratio between inlet temp. and outlet temp. | $T_{in}/T_{out}$ | 2.246 |
| Ratio between inlet pressure and outlet press. | $P_{in}/P_{out}$ | 16.966872 |
x - position in axial direction
r - nozzle profile radius
r* - nozzle throat radius
| x/r* | r/r* |
|---|---|
| -7.000000 | 2.405410 |
| -6.784850 | 2.398160 |
| -6.569700 | 2.388990 |
| -6.354550 | 2.378520 |
| -6.139390 | 2.366050 |
| -5.924240 | 2.350850 |
| -5.709090 | 2.332240 |
| -5.493940 | 2.309430 |
| -5.278790 | 2.281500 |
| -5.063640 | 2.247500 |
| -4.848480 | 2.206480 |
| -4.633330 | 2.157550 |
| -4.418180 | 2.100720 |
| -4.203030 | 2.037070 |
| -3.987880 | 1.967700 |
| -3.772730 | 1.893730 |
| -3.557580 | 1.816530 |
| -3.342420 | 1.737710 |
| -3.127270 | 1.658850 |
| -2.912120 | 1.581350 |
| -2.696970 | 1.506290 |
| -2.481820 | 1.434690 |
| -2.266670 | 1.367280 |
| -2.051520 | 1.304540 |
| -1.836360 | 1.246880 |
| x/r* | r/r* |
|---|---|
| -1.621210 | 1.194590 |
| -1.406060 | 1.147960 |
| -1.190910 | 1.107220 |
| -0.975758 | 1.072650 |
| -0.760606 | 1.044500 |
| -0.545455 | 1.023030 |
| -0.330303 | 1.008480 |
| -0.115152 | 1.001030 |
| 0.100000 | 1.000780 |
| 0.315152 | 1.007640 |
| 0.530303 | 1.021300 |
| 0.745455 | 1.041080 |
| 0.960606 | 1.065910 |
| 1.175760 | 1.094490 |
| 1.390910 | 1.125470 |
| 1.606060 | 1.157720 |
| 1.821210 | 1.190350 |
| 2.036360 | 1.222700 |
| 2.251520 | 1.254310 |
| 2.466670 | 1.284850 |
| 2.681820 | 1.314100 |
| 2.896970 | 1.341920 |
| 3.112120 | 1.368220 |
| 3.327270 | 1.392940 |
| 3.542420 | 1.416070 |
| x/r* | r/r* |
|---|---|
| 3.757580 | 1.437600 |
| 3.972730 | 1.457550 |
| 4.187880 | 1.475950 |
| 4.403030 | 1.492860 |
| 4.618180 | 1.508310 |
| 4.833330 | 1.522330 |
| 5.048480 | 1.535040 |
| 5.263640 | 1.546490 |
| 5.478790 | 1.556690 |
| 5.693940 | 1.565740 |
| 5.909090 | 1.573790 |
| 6.124240 | 1.580870 |
| 6.339390 | 1.587000 |
| 6.554550 | 1.592300 |
| 6.769700 | 1.596910 |
| 6.984850 | 1.600870 |
| 7.200000 | 1.604200 |
| 7.415150 | 1.606970 |
| 7.630300 | 1.609310 |
| 7.845450 | 1.611290 |
| 8.060610 | 1.612940 |
| 8.275760 | 1.614230 |
| 8.490910 | 1.615220 |
| 8.706060 | 1.616000 |
| 8.921210 | 1.616650 |
| x/r* | r/r* |
|---|---|
| 9.136360 | 1.617200 |
| 9.351520 | 1.617620 |
| 9.566670 | 1.617910 |
| 9.781820 | 1.618100 |
| 9.996970 | 1.618220 |
| 10.212100 | 1.618320 |
| 10.427300 | 1.618410 |
| 10.642400 | 1.618490 |
| 10.857600 | 1.618540 |
| 11.072700 | 1.618570 |
| 11.287900 | 1.618590 |
| 11.503000 | 1.618590 |
| 11.718200 | 1.618600 |
| 11.933300 | 1.618610 |
| 12.148500 | 1.618610 |
| 12.363600 | 1.618620 |
| 12.578800 | 1.618620 |
| 12.793900 | 1.618620 |
| 13.009100 | 1.618620 |
| 13.224200 | 1.618620 |
| 13.439400 | 1.618620 |
| 13.654500 | 1.618620 |
| 13.869700 | 1.618620 |
| 14.084800 | 1.618620 |
| 14.300000 | 1.618620 |
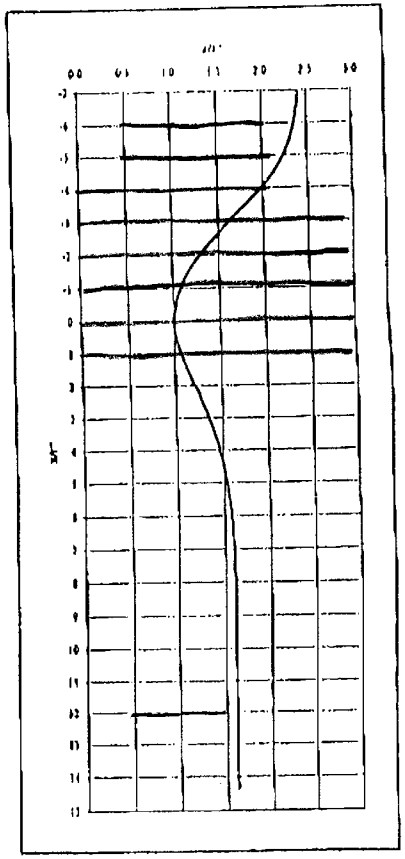
XIII Nozzle profile
| | | |
|---|---|---|
| Type of nozzle | | M - Medium |
| Dimensionless lenght of nozzle | $L/r^*$ | 17.40 |
| Mach inlet | $M_{in}$ | 0.1 |
| Mach outlet | $M_{out}$ | 2.5 |
| Ratio between inlet temp. and outlet temp. | $T_{in}/T_{out}$ | 2.246 |
| Ratio between inlet pressure and outlet press. | $P_{in}/P_{out}$ | 16.966872 |
x - position in axial direction
r - nozzle profile radius
r* - nozzle throat radius
| x/r* | r/r* |
|---|---|
| -5.700000 | 2.422220 |
| -5.524240 | 2.417930 |
| -5.348480 | 2.411200 |
| -5.172730 | 2.403650 |
| -4.996970 | 2.394760 |
| -4.821210 | 2.384050 |
| -4.645450 | 2.371030 |
| -4.469700 | 2.354980 |
| -4.293940 | 2.334480 |
| -4.118180 | 2.307870 |
| -3.942420 | 2.273530 |
| -3.766670 | 2.229840 |
| -3.590910 | 2.176150 |
| -3.415150 | 2.113450 |
| -3.239390 | 2.042890 |
| -3.063640 | 1.965620 |
| -2.887880 | 1.883220 |
| -2.712120 | 1.797870 |
| -2.536360 | 1.711730 |
| -2.360610 | 1.626780 |
| -2.184850 | 1.544460 |
| -2.009090 | 1.466120 |
| -1.833330 | 1.392700 |
| -1.657580 | 1.324690 |
| -1.481820 | 1.262510 |
| x/r* | r/r* |
|---|---|
| -1.306060 | 1.206360 |
| -1.130300 | 1.156420 |
| -0.954545 | 1.112900 |
| -0.778788 | 1.076030 |
| -0.603030 | 1.046080 |
| -0.427273 | 1.023350 |
| -0.251515 | 1.008140 |
| -0.075758 | 1.000740 |
| 0.100000 | 1.001280 |
| 0.275758 | 1.009640 |
| 0.451515 | 1.025160 |
| 0.627273 | 1.046540 |
| 0.803030 | 1.072130 |
| 0.978788 | 1.100350 |
| 1.154550 | 1.129980 |
| 1.330300 | 1.160160 |
| 1.506060 | 1.190290 |
| 1.681820 | 1.219950 |
| 1.857580 | 1.248860 |
| 2.033330 | 1.276800 |
| 2.209090 | 1.303640 |
| 2.384850 | 1.329290 |
| 2.560610 | 1.353680 |
| 2.736360 | 1.376780 |
| 2.912120 | 1.398580 |
| x/r* | r/r* |
|---|---|
| 3.087880 | 1.419070 |
| 3.263640 | 1.438270 |
| 3.439390 | 1.456180 |
| 3.615150 | 1.472850 |
| 3.790910 | 1.488300 |
| 3.966670 | 1.502550 |
| 4.142420 | 1.515660 |
| 4.318180 | 1.527710 |
| 4.493940 | 1.538670 |
| 4.669700 | 1.548620 |
| 4.845450 | 1.557660 |
| 5.021210 | 1.565810 |
| 5.196970 | 1.573080 |
| 5.372730 | 1.579560 |
| 5.548480 | 1.585330 |
| 5.724240 | 1.590430 |
| 5.900000 | 1.594860 |
| 6.075760 | 1.598670 |
| 6.251520 | 1.601970 |
| 6.427270 | 1.604830 |
| 6.603030 | 1.607290 |
| 6.778790 | 1.609340 |
| 6.954550 | 1.611020 |
| 7.130300 | 1.612420 |
| 7.306060 | 1.613620 |
| x/r* | r/r* |
|---|---|
| 7.481820 | 1.614620 |
| 7.657580 | 1.615440 |
| 7.833330 | 1.616050 |
| 8.009090 | 1.616500 |
| 8.184850 | 1.616840 |
| 8.360610 | 1.617120 |
| 8.536360 | 1.617370 |
| 8.712120 | 1.617560 |
| 8.887880 | 1.617710 |
| 9.063640 | 1.617810 |
| 9.239390 | 1.617870 |
| 9.415150 | 1.617900 |
| 9.590910 | 1.617930 |
| 9.766670 | 1.617960 |
| 9.942420 | 1.617990 |
| 10.118200 | 1.618010 |
| 10.293900 | 1.618020 |
| 10.469700 | 1.618030 |
| 10.645500 | 1.618030 |
| 10.821200 | 1.618030 |
| 10.997000 | 1.618030 |
| 11.172700 | 1.618030 |
| 11.348500 | 1.618030 |
| 11.524200 | 1.618040 |
| 11.700000 | 1.618040 |
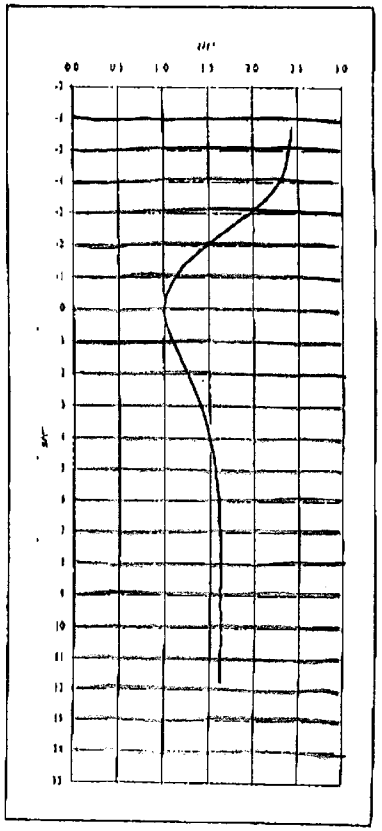
XIV Nozzle profile
| | | |
|---|---|---|
| Type of nozzle | | S - Short |
| Dimensionless lenght of nozzle | $L/r^*$ | 15.10 |
| Mach inlet | $M_{in}$ | 0.1 |
| Mach outlet | $M_{out}$ | 2.5 |
| Ratio between inlet temp. and outlet temp. | $T_{in}/T_{out}$ | 2.246 |
| Ratio between inlet pressure and outlet press. | $P_{in}/P_{out}$ | 16.966872 |
x - position in axial direction
r - nozzle profile radius
r* - nozzle throat radius
| x/r* | r/r* |
|---|---|
| -4.900000 | 2.436640 |
| -4.747470 | 2.433830 |
| -4.594950 | 2.429240 |
| -4.442420 | 2.424330 |
| -4.289900 | 2.418900 |
| -4.137370 | 2.412760 |
| -3.984850 | 2.405710 |
| -3.832320 | 2.397190 |
| -3.679800 | 2.385160 |
| -3.527270 | 2.367150 |
| -3.374750 | 2.340700 |
| -3.222220 | 2.303360 |
| -3.069700 | 2.253850 |
| -2.917170 | 2.192850 |
| -2.764650 | 2.121240 |
| -2.612120 | 2.039930 |
| -2.459600 | 1.950760 |
| -2.307070 | 1.856830 |
| -2.154550 | 1.761290 |
| -2.002020 | 1.666950 |
| -1.849490 | 1.575760 |
| -1.696970 | 1.489520 |
| -1.544440 | 1.409390 |
| -1.391920 | 1.335890 |
| -1.239390 | 1.269310 |
| x/r* | r/r* |
|---|---|
| -1.086870 | 1.209720 |
| -0.934343 | 1.157130 |
| -0.781818 | 1.111630 |
| -0.629293 | 1.073410 |
| -0.476768 | 1.042760 |
| -0.324242 | 1.020040 |
| -0.171717 | 1.005680 |
| -0.019192 | 1.000070 |
| 0.133333 | 1.003390 |
| 0.285859 | 1.015110 |
| 0.438384 | 1.033610 |
| 0.590909 | 1.056740 |
| 0.743434 | 1.082660 |
| 0.895960 | 1.110090 |
| 1.048480 | 1.138210 |
| 1.201010 | 1.166450 |
| 1.353540 | 1.194430 |
| 1.506060 | 1.221870 |
| 1.658590 | 1.248590 |
| 1.811110 | 1.274440 |
| 1.963640 | 1.299320 |
| 2.116160 | 1.323170 |
| 2.268690 | 1.345950 |
| 2.421210 | 1.367620 |
| 2.573740 | 1.388180 |
| x/r* | r/r* |
|---|---|
| 2.726260 | 1.407620 |
| 2.878790 | 1.425960 |
| 3.031310 | 1.443180 |
| 3.183840 | 1.459350 |
| 3.336360 | 1.474460 |
| 3.488890 | 1.488530 |
| 3.641410 | 1.501620 |
| 3.793940 | 1.513770 |
| 3.946460 | 1.524980 |
| 4.098990 | 1.535300 |
| 4.251520 | 1.544790 |
| 4.404040 | 1.553470 |
| 4.556570 | 1.561350 |
| 4.709090 | 1.568480 |
| 4.861620 | 1.574950 |
| 5.014140 | 1.580770 |
| 5.166670 | 1.585930 |
| 5.319190 | 1.590480 |
| 5.471720 | 1.594500 |
| 5.624240 | 1.598070 |
| 5.776770 | 1.601190 |
| 5.929290 | 1.603870 |
| 6.081820 | 1.606150 |
| 6.234340 | 1.608100 |
| 6.386870 | 1.609790 |
| x/r* | r/r* |
|---|---|
| 6.539390 | 1.611240 |
| 6.691920 | 1.612440 |
| 6.844440 | 1.613390 |
| 6.996970 | 1.614140 |
| 7.149490 | 1.614750 |
| 7.302020 | 1.615270 |
| 7.454550 | 1.615710 |
| 7.607070 | 1.616070 |
| 7.759600 | 1.616340 |
| 7.912120 | 1.616530 |
| 8.064650 | 1.616650 |
| 8.217170 | 1.616750 |
| 8.369700 | 1.616830 |
| 8.522220 | 1.616900 |
| 8.674750 | 1.616960 |
| 8.827270 | 1.617010 |
| 8.979800 | 1.617040 |
| 9.132320 | 1.617060 |
| 9.284850 | 1.617070 |
| 9.437370 | 1.617070 |
| 9.589900 | 1.617080 |
| 9.742420 | 1.617080 |
| 9.894950 | 1.617090 |
| 10.047500 | 1.617090 |
| 10.200000 | 1.617100 |
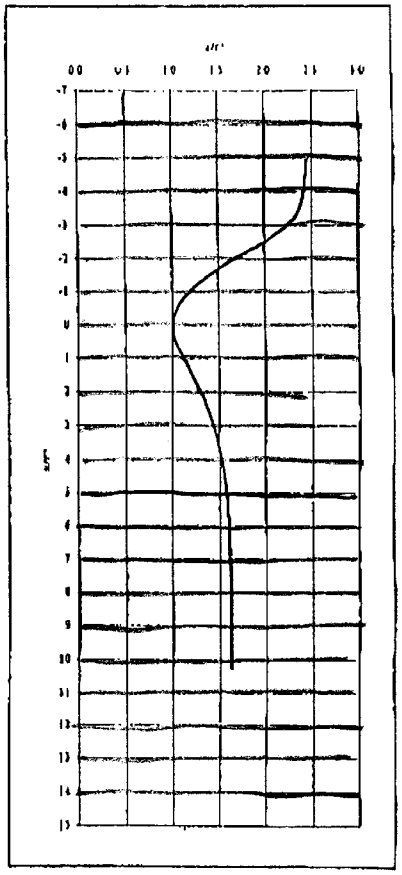
XV

NOZZLE FOR DEVICE TO INJECT OXYGEN AND TECHNOLOGICAL GASES AND RELATIVE DIMENSIONING METHOD

FIELD OF THE INVENTION

This invention concerns a nozzle for a device to inject oxygen and technological gases, and also the relative dimensioning method.

The device is used to inject at supersonic velocity a gassy flow of oxygen or other technological gases used in metallurgical processes of metal melting.

The nozzle according to the invention can be used advantageously, though not exclusively, in an integrated injection device suitable to emit, with the supersonic gassy flow, another flow, at subsonic velocity, either gassy, liquid or consisting of solid fuels in powder form or in little particles.

BACKGROUND OF THE INVENTION

It is common practice in electric arc furnaces, and in other applications of steel and metal working industries, to inject, by means of lances or other types of devices, technological gases and liquid and solid fuels above and inside the bath of melting metal.

The purposes of this injection are manifold and known to anyone operating in this field One problem which operators in this field particularly complain of is how to achieve a nozzle which will make it possible to obtain the maximum productivity in injection operations at supersonic velocity of a gassy flow of oxygen or other technological gases.

In the dimensioning of the supersonic nozzles of the injection devices, from the fluido-dynamic point of view there are two fundamental parameters to take into account in order to ensure maximum performance:

outlet velocity of the gassy jet;

density of the penetrating jet, defined as the ratio between the momentum and the area of the section penetrated.

From the operating point of view, the optimum solution would suggest mounting the injection device on the walls of the furnace, putting the end, or emission nozzle, far from the bath of metal, in such a way as to preserve it from such damaging elements as the extremely high temperature, the splashes of molten metal, corrosion and impacts with the scrap.

This also allows to reduce the cooling requirements of the head of the device.

This operating constraint contrasts with the technological aspects linked to the fluido-dynamic performance of the gassy jet, since it requires a considerable increase in the outlet velocity of the flow to keep density high as it passes through the layer of slag to the point of entry into the bath of metal.

It is also obvious that the farther the emission point of the injection device is from the zone of impact in the bath of metal, the more risk there is of weakening and dispersing the jet, and therefore of loss of performance and precision in the injection.

At present there are no solutions known to the state of the art wherein the problem of dimensioning the nozzles has been faced in the light of satisfying all these contrasting requirements.

Until now, the dimensioning of devices with nozzles of a constant section has been achieved according to conventional criteria of one-dimension calculation, which limit the outlet velocity of the gassy jet to values of not more than 1 Mach.

Moreover, these dimensioning criteria have the disadvantage that, in order to obtain the desired outlet velocity for a given diameter of the injection device and for a given surface roughness, the length of the device must be increased; consequently, to prevent choking, high stagnation pressures have to be used, which often cannot be obtained in practical applications in steel working plants.

By exploiting the geometry of the nozzles with a convergent/divergent development, it has been possible to obtain higher outlet velocities; however, due to the inaccuracies of present dimensioning criteria, based on empirical data or on simplified analytical methods, the velocity and pressure profiles obtained along the nozzle and in correspondence with the outlet thereof often have a high level of instability and therefore limited performance.

When the emergent gassy jet interacts with the surrounding atmosphere of the furnace, high and irreversible pressure losses therefore occur which impede and prevent high performance and operating efficiency being obtained.

Even when more evolved and sophisticated methods have been proposed for dimensioning the nozzles of the lances, (see for example the document by J. D. Anderson Jr. "Fundamentals of Aerodynamics", McGraw-Hill, 1991), these methods have shown themselves to be applicable for dimensioning only the divergent part of the nozzle.

To obtain a complete dimensioning of the entire convergent/divergent development of the nozzle it is necessary to combine that method with a conventional method.

However, adopting that dimensioning method there is the problem of combining the resolution of a field of subsonic motion of an elliptic type with the solution of a field of supersonic motion of a hyperbolic type.

The transition between these two regions of flow gives a field of motion of a parabolic type which is very susceptible to instability.

The present Applicant, in the light of the shortcomings of the state of the art, and taking into account the technological requirements of preparing injection devices with high performance and high functionality, has developed an algorithm of dimensioning and calculation which allows to design nozzles suitable to satisfy all the operational and technological requirements.

The principle of the invention is based on the concept of optimising the conversion of potential energy into kinetic energy, so that the potential energy varies with respect to the axial coordinate of the nozzle following a law of the type with a hyperbolic tangent.

This invention is therefore achieved in a method of dimensioning and calculation which exploits the algorithm mentioned above and allows to obtain many advantages, overcoming the shortcomings of the state of the art.

SUMMARY OF THE INVENTION

The purpose of the invention is to define an inverse method of three-dimensional axi-symmetric dimensioning for nozzles with a convergent/divergent development applied on supersonic injection devices, hereinafter called simply lances, which allows to obtain a plurality of advantages with respect to traditional methods adopted until now.

A first advantage is that it is possible to achieve a nozzle with a geometry which develops in such a way as to adapt to the natural profile of the fall in pressure of the low delivered.

A second advantage is that the method according to the invention allows to obtain the profile of the whole nozzle without dividing it into a supersonic zone, a subsonic zone and a transit zone between the two.

Another advantage is that it is possible to obtain a great homogeneity of the profile of velocity and pressure along the nozzle, and particularly in correspondence with the outlet of the relative lance; this allows to obtain greater distances from the outlet along which the density of the jet can be maintained.

Moreover, a further advantage is that the operation to dimension the nozzle is considerably simplified.

The method according to the invention allows to achieve a nozzle with a convergent/divergent development, obtaining velocity and pressure profiles which are highly stable inside the nozzle itself in its different transverse sections; it also obtains a very limited sublayer, and extremely uniform values of pressure/temperature/velocity at the outlet, throughout the field of application of the technology.

According to the invention, the characteristics as above are obtained by optimising the fall in pressure along the convergent/divergent nozzle (Laval nozzle) in such a way that the fall in pressure follows a hyperbolic tangent development.

In other words, the approach adopted to obtain the dimensioning of the nozzle is an inverse approach, in the sense that the geometric development of the nozzle adapts to the natural profile of the fall in pressure of the gas, instead of imposing it arbitrarily with its geometric configuration In this way, the geometry of the nozzle is adapted to the natural fall in pressure of the gassy flow which travels through the nozzle and therefore we obtain an optimum variation of the thermodynamic parameters, according to the natural laws of expansion. The geometry of the convergent/divergent configuration of the nozzle alone causes the fall in pressure of the gassy flow to follow a hyperbolic tangent law.

The method according to the invention allows to establish a substantially univocal relationship between velocity, static pressure and delivery of the flow in relation to the geometry of the nozzle.

This relationship allows to correlate the individual sizes analytically and to achieve the dimensioning of the nozzle according to the required performance based on the specific operating technological requirements.

According to the invention, the outlet velocities of the flow from the nozzle are in the range of 1.5÷2.5 Mach, but the dimensioning method can be applied for the three-dimensional axi-symmetric dimensioning for different ranges of velocity.

According to the invention, considering as a parameter the ratio of the dimensionless length of the nozzle to the radius of the nozzle throat, the optimum length of the nozzle is such as to ensure that the ratio is in the range of 8–25.

According to the invention, the optimum value of the ratio between inlet temperature and temperature at outlet of the nozzle is in the range of 1.2÷2.5 while the ratio between pressure at inlet and pressure at outlet of the nozzle is in the range of 2–40.

According to a preferred embodiment of the invention, a curve representing an increase in the velocity of the gas from the inlet to the outlet of the nozzle is a hyperbolic curve that develops inversely to a curve of the fall of the pressure of the gas.

BRIEF DESCRIPTION OF THE DRWINGS

Figure 4:
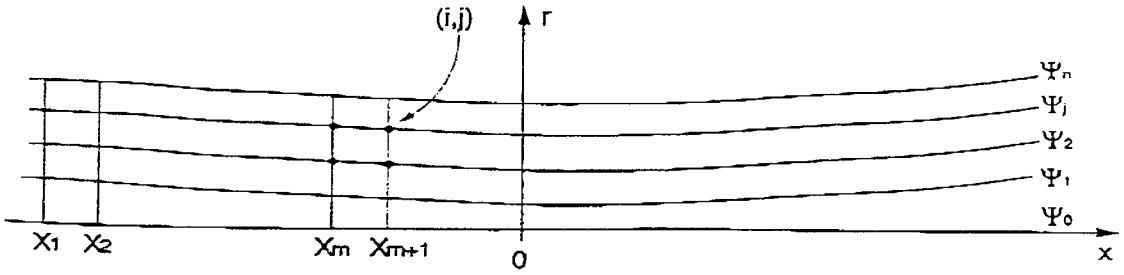
Figure 2A:
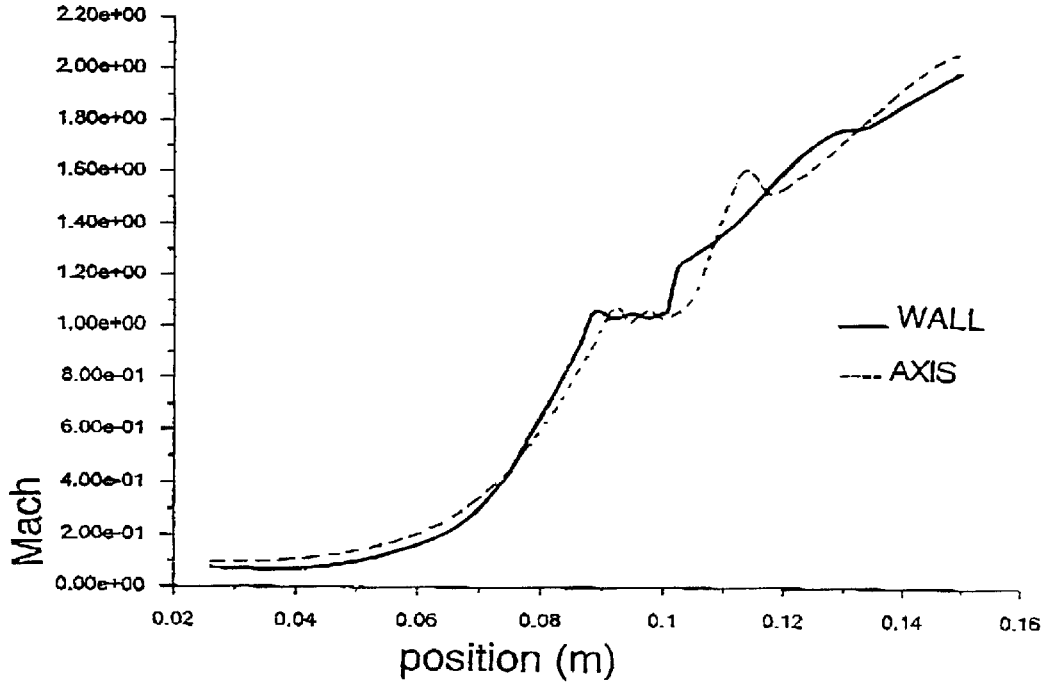
Figure 2B:
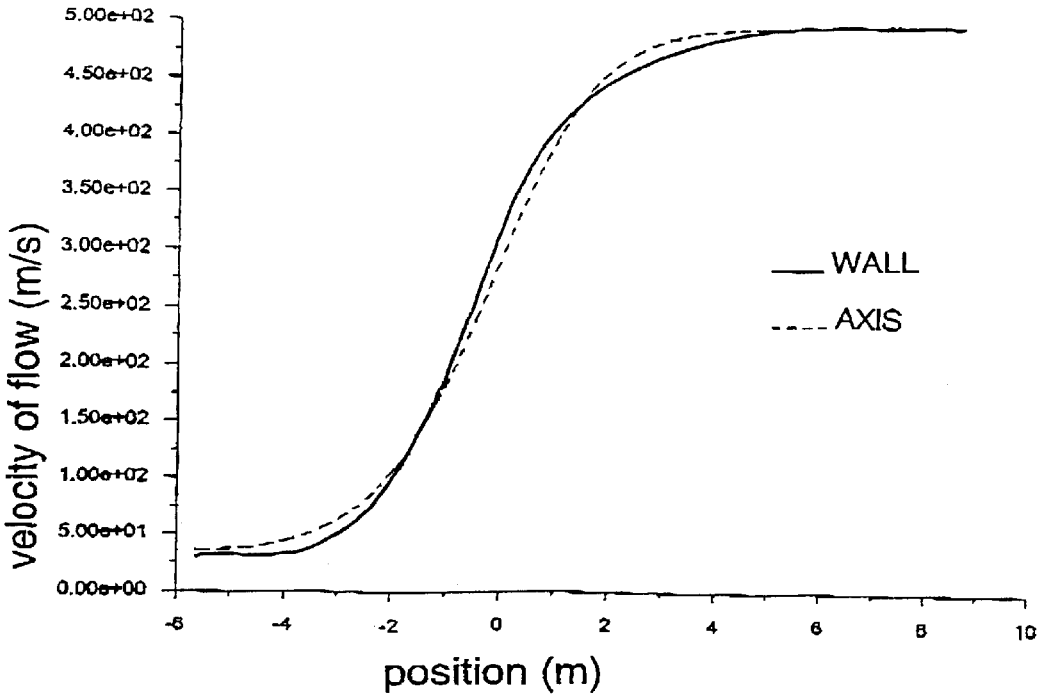
Figure 3A:
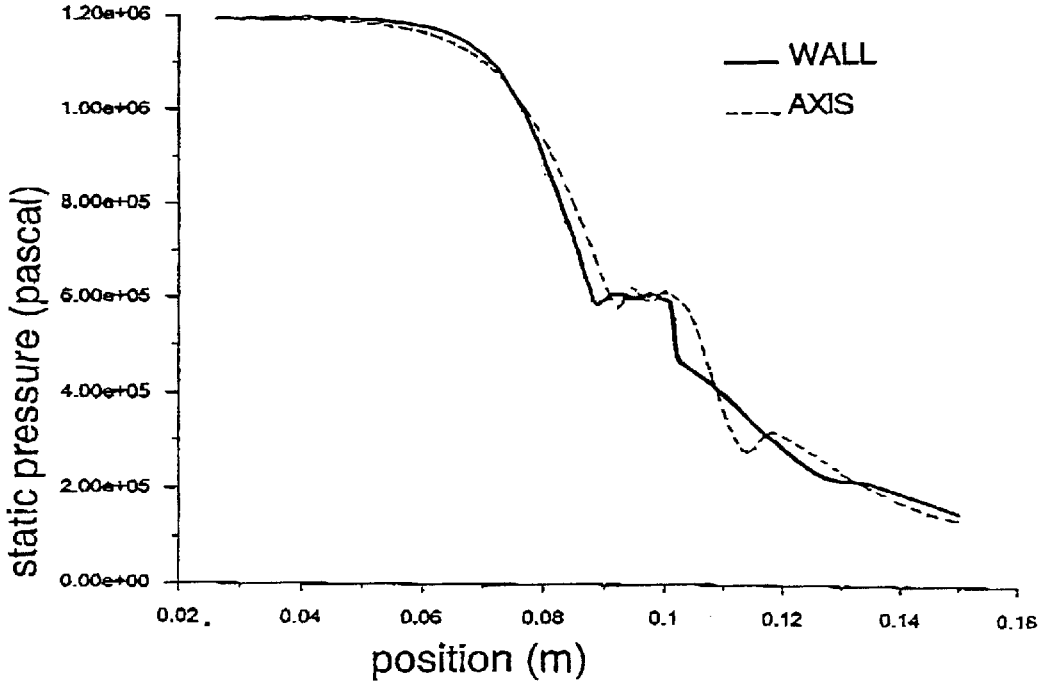
Figure 3B:
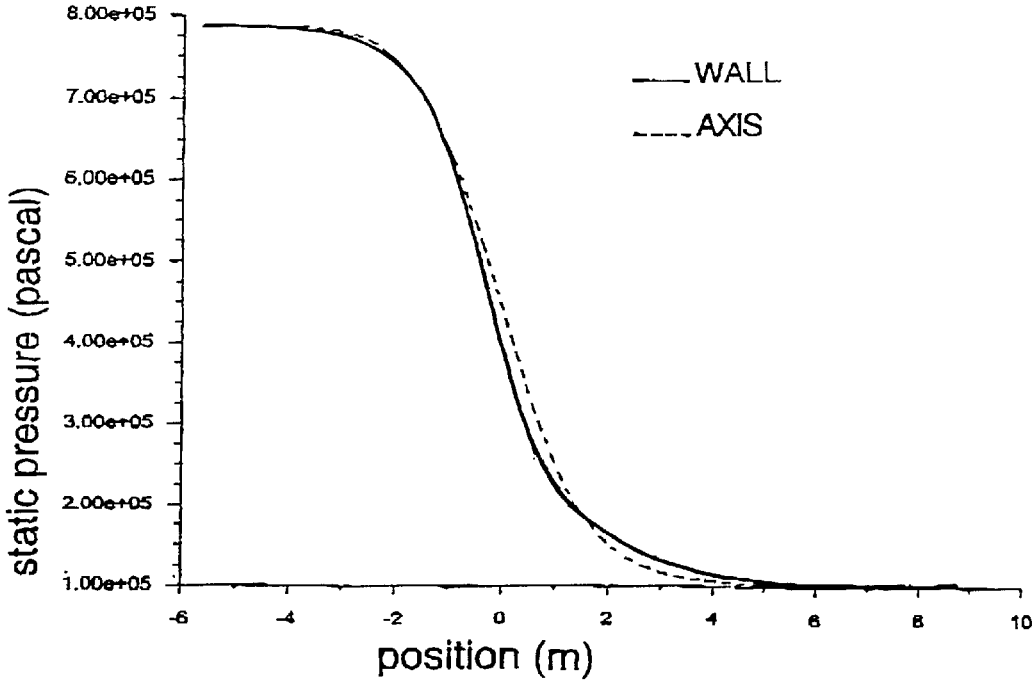

These and other purposes and advantages of the invention will become clear from the description of the preferential embodiment given as a non-restrictive example, with reference to the attached drawings, wherein:

FIG. 1 is a partial diagram of a section of a nozzle for a device to inject technological gases to which the method according to the invention is applied;

FIGS. 2*a* and 2*b* show two graphs in which the velocity of the flow is shown on the y axis and on the x axis the position, respectively, of a nozzle dimensioned according to the state of the art and a nozzle dimensioned according to the invention;

FIGS. 3*a* and 3*b* show two graphs in which the static pressure of the flow is shown on the y axis and on the x axis the position, respectively of a nozzle dimensioned according to the state of the art and a nozzle dimensioned according to the invention;

FIG. 4 shows the development of the radial coordinate r of the nozzle according to the axial co-ordinate x in relation to different constant values of the noralised function of flow Ψ;

TABLES I, II, III, IV, V, VI, VII, VIII, IX, X, XI, XII, XIII, XIX and XV show the ratios of the axial coordinate and the respective radial coordinate of the wall of the nozzle with respect to the radial coordinate in correspondence with the throat of the nozzle in the optimum range of the outlet velocities, calculated according to the dimensioning method of the invention.

DETAILED DESCRIPTION OF PREFERRED EMBODIMENT

With reference to the attached Figures, a nozzle 10 according to the invention is associated with a lance suitable to be mounted on the walls of a furnace for melting metals, or a vessel in general to perform metallurgical transformations.

The nozzle 10 has an outlet mouth 11 which is located at a defined distance from the upper level of the liquid bath and above the overlying layer of slag.

The lance is suitable to be inserted in a suitable aperture made on the wall of the furnace and to cooperate with appropriate equipment, of a type known to the state of the art, to manipulate and possibly to insert, remove and orient etc. the lance.

The nozzle 10 (FIG. 1) has a convergent/divergent (or Laval) conformation defined by a throat 12 made at a position upstream of the outlet mouth 11; the throat 12 defines a convergent part upstream and a divergent part downstream.

The geometry of the nozzle 10 can be defined according to an axial dimension (axis x), which coincides with the axis of symmetry of the nozzle 10, and a radial dimension (axis y).

The dimensioning method according to the invention is embodied in a calculation algorithm which allows to construct a system wherein the unknown or variable dependents are the velocity of flow, the density, the pressure and the temperature, connected by the state equation $f(p, \rho, T)=0$, and the radial coordinate, or radius r.

All these unknowns are defined according to the independent variable or axial coordinate x On the contrary, the static pressure on the axis is set as a design parameter according to the afore-said law of the hyperbolic tangent type.

The construction of the system is based on the fundamental equations of fluid dynamics and particularly, respectively, the continuity equation, the momentum preservation equation and the energy preservation equation.

$$\frac{d\rho}{dt} + \rho\nabla\overline{w} = 0: \tag{1.2.1}$$

$$\rho\frac{d\overline{w}}{dt} + \nabla p = 0: \tag{1.2.2}$$

$$\rho\frac{d}{dt}\left(h + \frac{w^2}{2}\right) = \frac{d\rho}{dt}: \tag{1.2.3}$$

In the above formulas, w is the velocity vector, ρ is the density of the fluid, p is the static pressure and h is the enthalpy.

To these eguations the state equations must be added:

$$h=h(T) \tag{1.2.4}$$

$$p = RT\frac{\rho}{\mu} \tag{1.2.5}$$

where R is the universal constant of the gas, T is the temLperature on the absolute scale and $\mu$ is the molecular mass of the means.

Since the analysis refers to the stationary case, the derivative with respect to the time of the state variables is nil.

The axis of syrmetry is necessarily reduced to a rectilinear line of flow due to the axi-syrimetrical nature of the problem considered.

To carry out the calculations, we introduce an auxiliary function, or flow function Ψ, defined as that function according to which the scalar product of the velocity vector w and the gradient of the function Ψ is equal to zero.

$$\overline{w}\cdot\nabla\Psi=0 \tag{1.2.6}$$

Having defined u and v, respectively, as the components on the axis of symmetry x and in the radial direction r of the velocity vector w, then we have $$u\frac{\partial\Psi}{\partial x} + v\frac{\partial\Psi}{\partial r} = 0 \tag{1.2.6.b}$$

The equations which characterise the flow, introducing the exponent for the isentropic flow, are as follows:

$$\frac{\partial p}{\partial\Psi} = -\frac{\gamma}{r}\frac{\partial v}{\partial x} \tag{1.2.7}$$

$$\frac{\partial\tau^2}{\partial\Psi} = \frac{2}{\rho u} \tag{1.2.8}$$

$$\frac{\partial r}{\partial x} = \frac{v}{u} \tag{1.2.9}$$

$$p = \rho^\gamma \tag{1.2.10}$$

$$u = \left[\frac{\gamma+1}{\gamma-1} - \frac{2}{\gamma-1}p^{\frac{\gamma-t}{\gamma}} - v^2\right]^{1/2}. \tag{1.2.11}$$

If the real variables are indicated with an overlying sign, and the smallest radius of the nozzle, the radius in correspondence with the throat 12, is indicated by r*, the normalised dimensionless parameters are as follows:

$$u = \frac{\overline{u}}{a_-},\ v = \frac{\overline{v}}{a_-} \tag{1.2.12}$$

-continued $$r = \frac{\overline{r}}{r_*},\ x = \frac{\overline{x}}{r_*}$$

where $$a_- = \left(\frac{\gamma p_*}{p_*}\right)^{1/2}$$

is the sonic velocity in correspondence with the throat 12 of the nozzle (in critical conditions), p* is critical pressure and ρ* is critical density.

The normalised flow function can therefore be expressed thus:

$$\Psi = \frac{\overline{\Psi}}{\rho_* a_* r_*^2} \tag{1.2.13}$$

It is not necessary to normalise the spatial coordinates r and x with r*; in this way it is possible to change the scale of the flow function Ψ.

In order to solve the system of equations from 1.2.7 to 1.2.11, for every Ψ=const., it is necessary to estimate the unknown variables r, p, ρ, u and v, as dimensionless values, as a function of x starting from the inlet to the nozzle 10.

The problem is solved by applying the iterative algorithm of calculation on the variable Ψ, which requires an initial condition for Ψ.

On the axis of syrametry the value of $\Psi_0$=0, and therefore this value cannot be used as an initial condition.

The initial condition must be established by setting $\Psi=\Psi_1$ as will be explained later.

The points $x=x_i$ must be defined one after the other in the field of the nozzle 10.

These points, projected on the flow line $\Psi=\Psi_j$, supply a grid of points denoted by the subscript (i, j), called nodes, for each of which the values of the unknown parameters are calculated (FIG. 4).

The index varies from 0 to J.

It is not necessary to define the profile conditions in the limit sections $x=x_0$ and $x=y_J$ because in these points the urlknown variables r, p, ρ, u and v have a constant value.

If the nodal values r, p, ρ, u and v are known through $\Psi=\Psi_j$ then it is possible to determine the value of the unnnowns as above by means of $\Psi=\Psi_{j+1}$.

In the first place, it is necessary to calculate the value of r and p.

From the discretization of the equation 1.2.8, it follows that $$r_{ij+i}^{i|j|} = \left\{r_{ij}^2 + \left[\left(\frac{1}{\rho u}\right)_{i,j} + \left(\frac{1}{\rho u}\right)_{i,j+1}^{[t-1]}\right]\Delta\Psi\right\}^{1/2} \tag{1.2.14}$$

approximate to the second degree, since $$\left(\frac{1}{\rho u}\right)_{i,j-\frac{1}{2}}$$

is the central value.

Since $$\left(\frac{1}{\rho u}\right)_{[i,j+1]}^{[t-1]}$$

is unknown, the procedure is iterative.

In the initial conditions, for i=1, we suppose $$\left(\frac{1}{\rho u}\right)_{i,j+1}^{[0]} = \left(\frac{1}{\rho u}\right)_{i,j}$$

The iteration continues until sufficient precision is achieved, that is until the following equation is fulfilled $$\left[\left(\frac{1}{\rho u}\right)^{[i]} - \left(\frac{1}{\rho u}\right)^{[1-t]} < \varepsilon\right]$$

where $\epsilon$ represents the desired precision.

Similarly, after discretization, from the equation (1.2.7), we have:

$$p_{i,j+1}^{[t]} = p_{i,j} - \frac{1}{2}\gamma\left[\left(\frac{1}{r}\frac{\partial v}{\partial x}\right)_{i,j} + \left(\frac{1}{r}\frac{\partial v}{\partial x}\right)_{i,j+1}^{[t-1]}\right]\Delta\Psi \tag{1.2.15}$$

Based on achieved 1 iterations $r_{i,j\neq 1}^{[t]}$ and $p_{i,j=1}^{[t]}$ on $\Psi=\Psi_j$, $u_{i,j+1}^{[t]}$ and $p_{i,j\neq 1}^{[t]}$ can be calculated directly from the discretised equations (1.2.10) and (1.2.11).

Moreover from the relation v=w sin $\alpha$, where $\alpha$ is the angle between the velocity vector w and the axis x, we obtain the value of $v_{i,j+1}^{[t]}$.

The formulas are as follows:

3. $$v_{i,j+1}^{[t]} = \left(\left[\frac{\frac{\partial r}{\partial x}}{\sqrt{1+\left(\frac{\partial r}{\partial x}\right)^2}}\left(\frac{\gamma+1}{\gamma-1} - \frac{2}{\gamma-1}p\frac{\gamma-1}{\gamma}\right)^{1/2}\right]\right)^{[t]} \tag{1.2.16}$$

4. $$\rho_{i,j+1} = (p^{1/\gamma})_{i,j+1}^{[t]} \tag{1.2.17}$$

5. $$u_{i,j+1}^{[t]} = \left[\left(\frac{\gamma+1}{\gamma-1} - \frac{2}{\gamma-1}p^{\frac{\gamma-1}{\gamma}} - v^2\right)^{1/2}\right]_{i,j+1}^{[t]} \tag{1.2.18}$$

The algorithm is defined along the coordinate $\Psi$ and, for each $\Psi=\Psi_j$, it may be used to construct the geometry of the nozzle, that is, to find the radial coordinate r as a function of the axial coordinate X, as can be seen in FIG. 4.

Because of the different gradients of the functions in the area of the throat, it is necessary to apply short intervals $\Delta x$, which can be increased in size going towards the inlet or the outlet.

Because of the irregularities of the intervals $\Delta x$, it is also necessary to calculate the partial derivatives of v and r with respect to x using the equations:

$$\left(\frac{\partial f}{\partial x}\right)_{i,j} = (f_n)_{i-1j}x_i - \frac{x_{i+1}}{(x_i - x_{i+1})(x_{i+1} - x_{i-1})} + (f_n)_{ij}2x_i - \frac{(x_{i+1} + x_{i-1})}{(x_i - x_{i-1})(x_i - x_{i+1})} + \tag{1.2.19}$$

-continued $$(f_n)_{i+1j}x_i - \frac{x_{i-1}}{(x_{i+1} - x_{i-1})(x_{i+1} - x_i)}$$

on the flow line $\Psi=\Psi_j$.

With regard to the initial conditions we have already spoken about the need to estimate them on the curve $\Psi=\Psi_j$=const, which means that all the values $r_{i,1}$, $p_{i,1}$, $v_{i,1}$, $u_{i,1}$ and $\rho_{i,1}$ have to be calculated for all the $x_i=x_0 \ldots J$.

To this end, a new equation can be used, setting the hyperbolic tangent development, in order to determine the pressure $$\bar{p}/p_* = f(x_0)$$

on the axis of the nozzle ($\Psi$=0)

$$f(x,0) = a\ th(c-bx)+d \tag{1.3.1}$$

where $$a = \frac{1}{2}\left(\frac{\bar{p}_{in}}{p_*} - \frac{\bar{p}_{out}}{p_*}\right)$$

$$d = \frac{1}{2}\left(\frac{\bar{p}_{in}}{p_*} + \frac{\bar{p}_{out}}{p_*}\right)$$

$$c = arth\frac{1-d}{a}$$

The pressures $p_{in}$ and $p_{out}$ are the real pressures, respectively, at inlet and outlet.

A coefficient b>0 can be chosen as desired.

Choosing at will the parameters a, b, c and d it is possible to obtain different geometries of the nozzles with different velocities of flow at inlet and at outlet.

It is thus possible to choose the most suitable nozzles according to the application.

The afore-said conditions cannot be used directly as such.

The unknown values on the flow line $\Psi=\Psi_j$ can therefore be calculated by means of the following series expansion:

$$f(x,\Psi) = \sum_{n=0}^{N} f_n(x)\Psi^n + \sqrt{\Psi}\sum_{n=u}^{N} f_n'(x)\Psi^n \tag{1.3.2}$$

where, each time, f(x,$\Psi$)=r, p, v, $\rho$, or u on $\Psi=\Psi_j$ which has to be chosen near enough to the axis of symmetry.

One by one, the dependent variables have to be chosen in the following manner:

a) calculation of r.

From the equation (1.2.8), it follows that:

$$\rho ur\frac{\partial r}{\partial \Psi} = 1 \tag{1.3.3}$$

Deriving r with respect to $\Psi$, we have:

$$\frac{\partial r}{\partial \Psi} = \sum_{n=0}^{N} nr_0(x)\Psi^{n-1} + \frac{1}{2\sqrt{\Psi}}\sum_{n=0}^{N} r_n'(x)\Psi^n + \sqrt{\Psi}\sum_{n=0}^{N} nr_0'(x)\Psi^{n-1} \tag{1.3.4}$$

After multiplication, the coefficients on the left side with the same exponent must be equallised with those on the right side.

In this way, we obtain the values of the coefficients $r_n$ and $r'_n$.

b) calculation of v.

From the equation (1.2.7) it follows that:

$$v = u\frac{\partial r}{\partial x} \tag{1.3.5}$$

from which it is possible to calculate the coefficients $v_u$ and $v'_u$.

c) calculation of ρ

From the equation (1.2.10) it follows that:

$$\rho = p^{1/\gamma} \tag{1.3.6}$$

from which it is possible to calculate the coefficients $\rho_u$ and $\rho'_u$.

Finally, using the equation (1.2.11), we get:

$$\rho u\frac{\partial u}{\partial \Psi} + \rho v\frac{\partial v}{\partial \Psi} = -\frac{1}{\gamma}\frac{\partial p}{\partial \Psi} \quad \text{or} \tag{1.3.7}$$

$$u^2 + v^2 = \frac{\gamma+1}{\gamma-1} - \frac{2}{\gamma-1}\,p^{\frac{\gamma-1}{\gamma}}$$

On the axis of symmetry we have Ψ=0, r=0, $v_0$=0, and, from the equation (1.2.10), we have $\rho_0=p_0^{1/\gamma}$ while from the equation (1.2.11), we have $$u_0 = \left[\frac{\gamma+1}{\gamma-1} - \frac{2}{\gamma-1}\,p_n^{\frac{\gamma-1}{\gamma}}\right]$$

Finally, it follows $r_n(x)=0$, $p'_n(x)=0$, $v_n(x)=0$, $\rho'_n(x)=0$ and $u'_n(x)=0$ for every x.

As a result $$r(x) = \sqrt{\Psi_1}\sum_{n=0}^{N} r'_n(x)\Psi_1^n$$

$$p(x) = \sum_{n=0}^{N} p_n\Psi_1^n$$

$$v(x) = \sqrt{\Psi_1}\sum_{n=0}^{N} v_n(x)\Psi_1^n$$

-continued $$\rho(x) = \sum_{n=0}^{N} \rho_n\Psi_1^n$$

$$u(x) = \sum_{n=0}^{N} u_n(x)\Psi_1^n$$

In these equations, the coefficients are as follows:

coefficients $r'_n$:

$$r'_0 = \left(\frac{2}{u_0\rho_n}\right)^{\frac{1}{2}}$$

$$R'_1 = \frac{u_1}{u_0} + \frac{\rho_1}{\rho_0};\quad r'_1 = -\frac{1}{4}r'_0R'_1$$

$$R'_2 = \frac{u_2}{u_0} + \frac{u_1}{u_0}\frac{\rho_1}{\rho_0} + \frac{\rho_2}{\rho_0};\quad r'_2 = -\frac{1}{6}r'_0R'_2 - \frac{2}{3}r'_1R'_1 - \frac{1}{2}\frac{(r'_1)^2}{r'_0}$$

$$R'_3 = \frac{u_3}{u_0} + \frac{u_2}{u_0}\frac{\rho_1}{\rho_0} + \frac{u_1}{u_0}\frac{\rho_3}{\rho_0} + \frac{\rho_3}{\rho_0};\quad r'_3 = -\frac{1}{8}r'_0R'_3 - \frac{1}{2}r'_1R'_2 - \frac{3}{4}\left[r'_2 + \frac{1}{2}\frac{(r'_1)^2}{r'_0}\right]R'_1 - \frac{r'_2r'_1}{r'_0}$$

$$\vdots$$

$$R'_6 = \frac{u_6}{u_0} + \frac{u_5}{u_0}\frac{\rho_1}{\rho_0} + \frac{u_4}{u_0}\frac{\rho_2}{\rho_0} + \frac{u_3}{u_0}\frac{\rho_3}{\rho_0} + \frac{u_2}{u_0}\frac{\rho_4}{\rho_0} + \frac{u_1}{u_0}\frac{\rho_5}{\rho_0} + \frac{\rho_6}{\rho_0};$$

$$r'_6 = -\frac{1}{14}r'_0R'_6 - \frac{2}{7}r'_1R'_5 - \frac{3}{7}\left[r'_2 + \frac{1}{2}\frac{(r'_1)^2}{r'_0}\right]R'_4 - \frac{4}{7}\left(r'_5 + \frac{r'_2r'_1}{r'_0}\right)R'_3 - \frac{5}{7}\left[r'_4 + \frac{r'_3r'_1}{r'_0} + \frac{1}{2}\frac{(r'_2)^2}{r'_0}\right]R'_2 - \frac{6}{7}\left(r'_5 + \frac{r'_4r'_1}{r'_0} + \frac{r'_3r'_2}{r'_0}\right)R'_1 - \frac{r'_5r'_1}{r'_0} - \frac{r'_4r'_2}{r'_0} - \frac{1}{2}\frac{(r'_3)^2}{r'_0}$$

coefficients $p_n$:

$$p_1 = -\gamma\frac{1}{r'_0}\frac{\partial v'_0}{\partial x}$$

$$p_2 = -\frac{1}{2}\gamma\frac{1}{r'_0}\frac{\partial v'_1}{\partial x} - \frac{1}{2}p_1\frac{r'_1}{r'_0}$$

$$\vdots$$

$$p_6 = -\frac{1}{6}\gamma\frac{1}{r'_0}\frac{\partial v'_5}{\partial x} - \frac{5}{6}p_5\frac{r'_1}{r'_0} - \frac{2}{3}p_4\frac{r'_2}{r'_0} - \frac{1}{2}p_3\frac{r'_3}{r'_0} - \frac{1}{3}p_2\frac{r'_4}{r'_0} - \frac{1}{6}p_1\frac{r'_5}{r'_0}$$

where $$\frac{\partial v'_0}{\partial x} = (v'_0)_{i-1}\frac{x_i - x_{i-1}}{(x_i - x_{i-1})(x_{i-1} - x_{i-1})} + (v'_0)_i\frac{2x_i - (x_{i-1} + x_{i-1}}{(x_i - x_{i-1})(x_i - x_{i-1})} + (v'_0)_{i-1}\frac{x_i - x_{i-1}}{(x_{i-1} - x_{i-1})(x_{i-1} - x_i)}$$

coefficients to estimate the component of velocity $v_n$.

$$v'_0 = u_0\frac{\partial r'_0}{\partial x}$$

$$v'_1 = u_1\frac{\partial r'_0}{\partial x} + u_0\frac{\partial r'_1}{\partial x}$$

$$v'_2 = u_2\frac{\partial r'_0}{\partial x} + u_1\frac{\partial r'_1}{\partial x} + u_0\frac{\partial r'_2}{\partial x}$$

-continued $$v'_3 = u_3\frac{\partial r'_0}{\partial x} + u_2\frac{\partial r'_1}{\partial x} + u_1\frac{\partial r'_2}{\partial x} + u_0\frac{\partial r'_3}{\partial x}$$

$$v'_6 = u_6\frac{\partial r'_0}{\partial x} + u_5\frac{\partial r'_1}{\partial x} + u_4\frac{\partial r'_2}{\partial x} + u_3\frac{\partial r'_3}{\partial x} + u_2\frac{\partial r'_4}{\partial x} + u_1\frac{\partial r'_5}{\partial x} + u_0\frac{\partial r'_6}{\partial x}$$

where $$\left(\frac{\partial r'_n}{\partial x}\right)_i = (r'_n)_{i-1}\frac{x_i - x_{i-1}}{(x_i - x_{i-1})(x_{i+1} - x_{i-1})} + (r'_n)_i\frac{2x_i - (x_{i-1} + x_{i-1})}{(x_i - x_{i-1})(x_i - x_{i+1})} + (r'_n)_{i+1}\frac{x_i - x_{i-1}}{(x_{i+1} - x_{i-1})(x_{i+1} - x_i)}$$

coefficients to estimate the dernsities $\rho_n$ $$\rho_0 = p_0^{1/\gamma}$$

$$\frac{\rho_1}{\rho_0} = \frac{p_1}{\gamma p_0}$$

$$\frac{\rho_1}{\rho_0} = \frac{p_2}{\gamma p_0} - \frac{1}{2}\left(1 - \frac{1}{\gamma}\right)\frac{p_1}{p_0}\frac{\rho_1}{\rho_0}$$

$$\vdots$$

$$\frac{\rho_6}{\rho_0} = \frac{p_6}{\gamma p_0} - \frac{1}{6}\left(1 - \frac{5}{\gamma}\right)\frac{p_5}{p_0}\frac{\rho_1}{\rho_0} - \frac{1}{6}\left(2 - \frac{4}{\gamma}\right)\frac{p_4}{p_0}\frac{\rho_2}{\rho_0} - \frac{1}{2}\left(1 - \frac{1}{\gamma}1\right)\frac{p_3}{p_0}\frac{\rho_3}{\rho_0} - \frac{1}{6}\left(4 - \frac{2}{\gamma}\right)\frac{p_2}{p_0}\frac{\rho_4}{\rho_0} - \frac{1}{6}\left(5 - \frac{1}{\gamma}\right)\frac{p_1}{p_0}\frac{\rho_5}{\rho_0}$$

coefficients to estimate the component of velocity $u_n$ $$u_0 = \left(\frac{\gamma + 1}{\gamma - 1} - \frac{2}{\gamma - 1}p_0^{\frac{r-1}{r}}\right)^{1/2}$$

$$u_1 = \frac{1}{\gamma}\frac{1}{\rho_0 u_0}p_2 - \frac{1}{2}\frac{(v'_0)^2}{u_0}$$

$$u_2 = \frac{1}{\gamma}\frac{1}{\rho_0 u_0}p_2 - \frac{1}{2}u_1\frac{\rho_1}{\rho_0} - \frac{1}{2}\frac{(u_i)^2}{u_0} - \frac{v'_1 v'_0}{u_0} - \frac{1}{4}\frac{\rho_t}{\rho_0}\frac{(v'_0)^2}{u_0}$$

$$\vdots$$

$$u_6 = \frac{1}{\gamma}\frac{1}{\rho_0 u_0}p_6 - \frac{5}{6}\frac{\rho_1}{\rho_0}u_5 - \frac{2}{3}\frac{\rho_2}{\rho_0}u_4 - \frac{1}{2}\frac{\rho_3}{\rho_0}u_3 - \frac{1}{3}\frac{\rho_4}{\rho_0}u_2 - \frac{1}{6}\frac{\rho_5}{\rho_0}u_1 - \frac{u_5 u_1}{u_0} - \frac{5}{6}\frac{\rho_1}{\rho_0}u_4\frac{u_1}{u_0} - \frac{2}{3}\frac{\rho_2}{\rho_0}u_3\frac{u_1}{u_0} - \frac{1}{2}\frac{\rho_3}{\rho_0}u_2\frac{u_1}{u_0} - \frac{1}{6}\frac{\rho_2}{\rho_0}\frac{(u_1)^2}{u_0} - \frac{u_4 u_2}{u_0} - \frac{5}{6}\frac{\rho_1}{\rho_0}u_3\frac{u_2}{u_0} - \frac{1}{2}\frac{(u_3)^2}{u_0} - \frac{1}{3}\frac{\rho_2}{\rho_0}\frac{(u_2)^2}{u_0} - \frac{v'_5 v'_0}{u_0} - \frac{5}{6}\frac{\rho_1}{\rho_0}v'_4\frac{v'_0}{u_0} - \frac{2}{3}\frac{\rho_2}{\rho_0}v'_3\frac{v'_0}{u_0} - \frac{1}{2}\frac{\rho_3}{\rho_0}v'_2\frac{v'_0}{u_0} - \frac{1}{3}\frac{\rho_4}{\rho_0}v'_1\frac{v'_0}{u_0} - \frac{1}{2}\frac{\rho_5}{\rho_0}\frac{(v'_0)^2}{u_0} - \frac{v'_4 v'_1}{u_0} - \frac{5}{6}\frac{\rho_1}{\rho_0}v'_3\frac{v'_1}{u_0} - \frac{2}{3}\frac{\rho_2}{\rho_0}v'_2\frac{v'_1}{u_0} - \frac{1}{4}\frac{\rho_3}{\rho_0}\frac{(v'_1)^2}{u_0} - \frac{v'_3 v'_2}{u_0} - \frac{5}{12}\frac{\rho_1}{\rho_0}\frac{(v'_2)^2}{u_0}$$

The geometry calculated with the method according to the invention can therefore be calculated according to the delivery desired but, in the optimnum field of the outlet velocities (1,5+2,5 Mach), the ratios of the axial coordinate and the corresponding radial coordinate of the wall of the nozzle with respect to the radial coordinate in correspondence with the throat 12 of the nozzle 10 are those indicated in the Tables from I to XV.

It can be seen from the Tables that the nozzle 10 preferentially has a dimensionless length L/r* of between 11.40 and 16.00 for an outlet velocity of 1.5 Mach; a dimensionless length L/r* of between 11.80 and 16.70 for an outlet velocity of 1.8 Mach; a dimensionless length L/r* of between 12.60 and 17.70 for an outlet velocity of 2.0 Mach; a dimensionless length L/r* of between 13.80 and 19.50 for an outlet velocity of 2.3 Mach and a dimensionless length L/r* of between 21.30 and 15.10 for an outlet velocity of 2.5 Mach.

The ratio r/r* of the radial coordinate of the wall of the nozzle 10 with respect to the radial coordinate in correspondence with the throat 12, taken at the entrance to the nozzle 10, according to the invention is between about 2.38 and about 2.46 for all the values of outlet velocity of the flow.

The same ratio r/r* taken at the outlet of the nozzle 10 varies from a minimum value of about 1.084, for the lowest velocities of 1.5 Mach, to a maximuinm value of about 1.618 for the highest velocities of 2.5 Mach, with intermediate values for the corresponding intermediate velocities.

The results obtained with the method according to the invention (FIGS. 2*b* and 3*b*) also show a uniformity of the fields of velocity and pressure which is significantly better than that obtained with conventional embodiments (FIGS. 2*a* and 3*a*).

What is claimed is:

1. A nozzle for a device to inject oxygen and technological gases used in metallurgical processing of metal melting, the nozzle being suitable to emit a gassy flow at supersonic velocity, the nozzle having an inlet and an outlet ending in a mouth, and having a conformation symmetrical to a central axis (x) defined by a throat arranged between the inlet and the outlet, the throat defining a convergent upstream part and a divergent downstream part which ends in the mouth of the outlet, wherein the nozzle has a convergent/divergent configuration with a geometry that consistently causes the fall in pressure of the gassy flow from the inlet to the outlet to follow a hyperbolic tangent law.

2. The nozzle as in claim 1, including the additional limitation that the geometry of the nozzle's convergent/divergent configuration is such that the outlet velocities of the gassy flow from the nozzle are within a range of 1.5 Mach and 2.5 Mach.

3. The nozzle as in claim 1, wherein the ratio between the total length of the nozzle and the smallest radius of the throat (r*) is between 8 and 25.

4. The nozzle as in claim 1, including the additional limitation that the geometry of the nozzle's convergent/divergent configuration is such that the ratio between the temperature of the gassy flow at the inlet to the nozzle and the temperature at the outlet of the nozzle is between 1.2 and 2.5.

5. The nozzle as in claim 1, including the additional limitation that the geometry of the nozzle's convergent/divement configuration is such that the ratio between the static pressure of the gassy flow at the inlet to the nozzle and the static pressure at the outlet of the nozzle is between 2 and 40.

6. The nozzle as in claim 1, wherein the ratio (r/r*) of the radius of the internal channel of the nozzle, as measured at the entrance of the nozzle, and the smallest radius of the throat is between about 2.38 and about 2.46.

7. The nozzle as in claim 1, wherein the ratio (r/r*) of the radius of the internal channel of the nozzle, as measured at the entrance of the nozzle, and the smallest radius of the throat varies from a minimum value of about 1.084, for the lowest velocities of 1.5 Mach, to a maximum value of about 1.618 for the highest velocities of 2.5 Mach, with intermediate values for corresponding intermediate velocities.

8. The nozzle as in claim 1, including the additional limitation that the geometry of the nozzle's convergent/ divergent configuration is such that the curves of velocity and pressure from the inlet to the outlet of the nozzle are uniform.

9. A method for making a nozzle for a device that injects oxygen and technological gases into a molten metal bath, the method utilizing inverse dimensioning and comrising:

obtaining a nozzle having an inlet and an outlet ending in a mouth, and having a conformation symmetrical to a central axis (x) defined by a throat arranged between the inlet and the outlet, the throat defining a convergent upstream part and a divergent downstream part which ends in the mouth of the outlet;

flowing a gas through the nozzle;

measuring the natural fall in pressure of the gassy flow through the nozzle; and modifying the geometry of the nozzle until the fall in pressure of the gassy flow follows a hyerbolic tangent law.

10. The method as in claim 9, wherein all dimensioning parameters of the nozzle are calculated by:

setting, as a design parameter, that the static pressure on the axis of the nozzle varies according to a hyperbolic tangent law, and calculating other parameters of velocity of flow, density, temperature and radial coordinate, as a function of the axial coordinate (x) taken as an independent variable.

11. The method as in claim 9, wherein the modifying step further includes modifying the geometry of the nozzle until the outlet velocities of the gassy flow from the nozzle are within a range of 1.5 Mach and 2.5 Mach.

12. The method as in claim 9, wherein the modifying step further includes modifying the geometry of the nozzle until the ratio between the total length of the nozzle and the smallest radius of the throat (r*) is between 8 and 25.

13. The method as in claim 9, wherein the modifying step further includes modifying the geometry of the nozzle until the ratio between the temperature of the gassy flow at the inlet to the nozzle and the temperature at the outlet of the nozzle is between 1.2 and 2.5.

14. The method as in claim 9, wherein the modifying step further includes modifying the geometry of the nozzle until the ratio between the static pressure of the gassy flow at the inlet to the nozzle and the static pressure at the outlet of the nozzle is between 2 and 40.

15. The method as in claim 9, wherein the modifying step further includes modifying the geometry of the nozzle until the ratio (r/r*) of the radius of the internal channel of the nozzle, as measured at the entrance of the nozzle, and the smallest radius of the throat is between about 2.38 and about 2.46.

16. The method as in claim 9, wherein the modifying step further includes modifying the geometry of the nozzle until the ratio (r/r*) of the radius of the internal channel of the nozzle, as measured at the entrance of the nozzle, and the smallest radius of the throat varies from a minimum value of about 1.084, for the lowest velocities of 1.5 Mach, to a maximum value of about 1.618 for the highest velocities of 2.5 Mach, with intermediate values for corresponding intermediate velocities.

17. The method as in claim 9, wherein the modifying step further indudes modifying the geometry of the nozzle until the curves of velocity and pressure from the inlet to the outlet of the nozzle are uniform.

18. A nozzle made by the method of claim 9.

19. The nozzle of claim 1, wherein a curve representing an increase in the velocity of the gas from the inlet to the outlet of the nozzle is a hyperbolic curve that develops inversely to a curve of the fall of the pressure of the gas.

20. The nozzle of claim 1, wherein the geometry of the convergent/divergent configuration of the nozzle alone causes the fall in pressure of the gassy flow to be properly represented by a hyperbolic tangent.

* * * * *